US010973339B2

(12) United States Patent
Lisenbee et al.

(10) Patent No.: US 10,973,339 B2
(45) **Date of Patent: *Apr. 13, 2021**

(54) POCKETED SPRING COMFORT LAYER HAVING AT LEAST ONE FOAM LAYER AND METHOD OF MAKING SAME

(71) Applicant: L&P Property Management Company, South Gate, CA (US)

(72) Inventors: Kyle S. Lisenbee, Carl Junction, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/934,193

(22) Filed: Jul. 21, 2020

(65) Prior Publication Data

US 2020/0345149 A1 Nov. 5, 2020

Related U.S. Application Data

(63) Continuation of application No. 16/018,646, filed on Jun. 26, 2018, now Pat. No. 10,750,877.

(51) Int. Cl.

| | |
|---|---|
| ***A47C 27/05*** | (2006.01) |
| ***B68G 7/054*** | (2006.01) |
| ***A47C 7/35*** | (2006.01) |
| ***A47C 7/18*** | (2006.01) |
| ***A47C 7/34*** | (2006.01) |
| ***B68G 7/10*** | (2006.01) |

(52) U.S. Cl.

CPC ..... *A47C 27/05* (2013.01); *A47C 7/18* (2013.01); *A47C 7/347* (2013.01); *A47C 7/35* (2013.01); *B68G 7/054* (2013.01); *B68G 7/10* (2013.01)

(58) Field of Classification Search

CPC ..... A47C 27/05; A47C 7/18; A47C 7/348; A47C 7/35; B68G 7/054; B68G 7/10

See application file for complete search history.

(56) References Cited

U.S. PATENT DOCUMENTS

| | | | |
|---|---|---|---|
| 4,234,983 | A | 11/1980 | Stumpf |
| 4,451,946 | A | 6/1984 | Stumpf |

(Continued)

FOREIGN PATENT DOCUMENTS

| | | | |
|---|---|---|---|
| EP | 1067090 | A1 | 1/2001 |
| EP | 1707081 | A1 | 10/2006 |

(Continued)

*Primary Examiner* — Robert G Santos
*Assistant Examiner* — Rahib T Zaman
(74) *Attorney, Agent, or Firm* — Wood Herron & Evans LLP

(57) ABSTRACT

A pocketed spring comfort layer for a bedding or seating product has pockets characterized by the individual mini coil springs of the comfort layer being pocketed with between at least one cushion assembly and a sheet of polypropylene fabric. Each cushion assembly includes at least one foam layer. A segmented seam joins the cushion assembly and the sheet of polypropylene fabric around each of the mini coil springs of the pocketed spring comfort layer. The method of making the pocketed spring comfort layer includes compressing the mini coil springs and creating pockets with a welding horn and an anvil.

20 Claims, 23 Drawing Sheets

(56) References Cited

U.S. PATENT DOCUMENTS

| | | | | |
|---|---|---|---|---|
| 4,485,506 | A | 12/1984 | Stumpf et al. | |
| 4,573,741 | A | 3/1986 | Kirchner-Carl | |
| 4,574,099 | A | 3/1986 | Nixon | |
| 4,578,834 | A | 4/1986 | Stumpf | |
| 4,594,278 | A | 6/1986 | Nixon | |
| 5,105,488 | A | 4/1992 | Hutchinson et al. | |
| 5,438,718 | A | 8/1995 | Kelly et al. | |
| 6,154,908 | A | 12/2000 | Wells | |
| 6,319,864 | B1 | 11/2001 | Hannigan et al. | |
| 6,447,874 | B2 | 9/2002 | Antinori et al. | |
| 6,490,744 | B1 * | 12/2002 | Schulz, Jr. | A47C 27/063 5/716 |
| 6,537,930 | B1 | 3/2003 | Middlesworth et al. | |
| 6,591,438 | B1 | 7/2003 | Edling | |
| 6,598,251 | B2 | 7/2003 | Habboub et al. | |
| 6,602,809 | B1 | 8/2003 | Cabrey | |
| 6,706,225 | B2 | 3/2004 | Cabrey | |
| 6,826,796 | B1 | 12/2004 | Mossbeck | |
| 6,862,763 | B2 | 3/2005 | Mossbeck et al. | |
| 6,883,196 | B2 | 4/2005 | Barber | |
| 7,410,030 | B2 | 8/2008 | Fusiki et al. | |
| 7,622,406 | B2 | 11/2009 | Holland et al. | |
| 7,636,972 | B2 | 12/2009 | Mossbeck et al. | |
| 7,788,952 | B2 | 9/2010 | Morrison | |
| 7,820,570 | B2 | 10/2010 | Holland et al. | |
| 7,828,029 | B2 | 11/2010 | Holland et al. | |
| 7,877,964 | B2 | 2/2011 | Spinks et al. | |
| 8,011,046 | B2 | 9/2011 | Stjerna | |
| 8,087,114 | B2 | 1/2012 | Lundevall | |
| 8,136,187 | B2 | 3/2012 | Mossbeck et al. | |
| 8,157,051 | B2 | 4/2012 | Marcel et al. | |
| 8,322,487 | B1 | 12/2012 | Kitchen et al. | |
| 8,464,830 | B2 | 6/2013 | Ishikawa et al. | |
| 8,474,078 | B2 | 7/2013 | Mossbeck | |
| 8,574,700 | B2 | 11/2013 | Hattori | |
| 8,695,757 | B2 | 4/2014 | Duval et al. | |
| 9,133,615 | B2 | 9/2015 | Bischoff et al. | |
| 9,635,952 | B1 | 5/2017 | Anthony et al. | |
| 9,943,173 | B2 * | 4/2018 | Krtek | A47C 27/05 |
| 9,968,202 | B2 * | 5/2018 | Long | A47C 27/064 |
| 10,405,665 | B2 * | 9/2019 | Long | A47C 21/046 |
| 10,512,340 | B2 | 12/2019 | Jewett | |
| 10,624,466 | B2 | 4/2020 | Krtek et al. | |
| 10,624,467 | B2 | 4/2020 | Krtek et al. | |
| 10,667,615 | B2 * | 6/2020 | Long | A47C 27/064 |
| 2002/0025747 | A1 | 2/2002 | Rock et al. | |
| 2003/0009831 | A1 | 1/2003 | Giori et al. | |
| 2003/0104735 | A1 | 6/2003 | Rock et al. | |
| 2004/0010853 | A1 | 1/2004 | Muci et al. | |
| 2005/0273938 | A1 | 12/2005 | Metzger et al. | |
| 2007/0044243 | A1 | 3/2007 | Metzger | |
| 2007/0137926 | A1 | 6/2007 | Albin et al. | |
| 2007/0289069 | A1 | 12/2007 | Wells | |
| 2008/0128965 | A1 | 6/2008 | Bock | |
| 2009/0211028 | A1 | 8/2009 | Richmond et al. | |
| 2009/0222985 | A1 | 9/2009 | Richmond et al. | |
| 2009/0298374 | A1 | 12/2009 | Delmas | |
| 2010/0043148 | A1 | 2/2010 | Rose et al. | |
| 2010/0212090 | A1 | 8/2010 | Stjerna | |
| 2010/0255270 | A1 | 10/2010 | Stuebiger | |
| 2011/0014406 | A1 | 1/2011 | Coleman et al. | |
| 2011/0113551 | A1 | 5/2011 | Lin | |
| 2011/0197367 | A1 * | 8/2011 | Mossbeck | A47C 27/064 5/655.8 |
| 2011/0314613 | A1 | 12/2011 | Haffner et al. | |
| 2012/0091644 | A1 * | 4/2012 | Ahn | A47C 27/065 267/142 |
| 2013/0000044 | A1 * | 1/2013 | Bullard | A47C 27/064 5/654.1 |
| 2013/0029550 | A1 | 1/2013 | Seth et al. | |
| 2013/0174350 | A1 | 7/2013 | Allman et al. | |
| 2013/0198941 | A1 | 8/2013 | John et al. | |
| 2014/0287643 | A1 | 9/2014 | Nozaki et al. | |
| 2014/0373282 | A1 | 12/2014 | Mossbeck et al. | |
| 2015/0026893 | A1 | 1/2015 | Garrett et al. | |
| 2015/0230621 | A1 | 8/2015 | Spinks et al. | |
| 2015/0284901 | A1 | 10/2015 | Blackwell, Jr. et al. | |
| 2015/0359349 | A1 | 12/2015 | Eigenmann et al. | |
| 2016/0235212 | A1 | 8/2016 | Krtek et al. | |
| 2016/0235213 | A1 | 8/2016 | Long | |
| 2017/0251820 | A1 | 9/2017 | Long | |
| 2018/0368584 | A1 | 12/2018 | Jewett | |
| 2019/0269251 | A1 | 9/2019 | Eigenmann et al. | |
| 2019/0343294 | A1 * | 11/2019 | DeMoss | B68G 9/00 |

FOREIGN PATENT DOCUMENTS

| | | | |
|---|---|---|---|
| EP | 2789267 | A1 | 10/2014 |
| GB | 167025 | A | 8/1921 |
| KR | 200462261 | Y1 | 9/2012 |
| WO | 2014023975 | A1 | 2/2014 |
| WO | 2017153427 | A1 | 9/2017 |

* cited by examiner

POCKETED SPRING COMFORT LAYER HAVING AT LEAST ONE FOAM LAYER AND METHOD OF MAKING SAME

CROSS-REFERENCE TO RELATED APPLICATIONS

This application is a Continuation of U.S. patent application Ser. No. 16/018,646 filed Jun. 26, 2018 (pending), the disclosure of which is incorporated by reference herein.

TECHNICAL FIELD OF THE INVENTION

This invention relates to a comfort layer for bedding and seating products. More particularly, this invention relates to a pocketed spring comfort layer for use in seating or bedding products and the method of manufacturing such comfort layer.

BACKGROUND OF THE INVENTION

Comfort layers are commonly used in seating or bedding products above/below a core, which may or may not include a spring assembly. The core is most commonly a pocketed or unpocketed spring core, but the core may be made partially or entirely of foam. Such comfort layers may include foam, fiber and gel products. U.S. Pat. Nos. 9,968,202 and 9,943,173 each disclose a comfort layer made of pocketed springs configured to overlay a spring core of a bedding or seating product. Such comfort layers commonly have one layer of fabric above and one layer of fabric below individually pocketed mini coil springs. The fabric is chosen to control air flow between pockets and into and out of the pockets.

One drawback to such pocketed spring comfort layers is that a mattress manufacturer may desire to place one or more foam or fiber layers above such a pocketed spring comfort layer so that a user does not detect or feel the pocketed spring comfort layer. In the case of a double-sided bedding or seating product, a mattress manufacturer may place one or more foam or fiber layers above one pocketed spring comfort layer and below another pocketed spring comfort layer on the opposite surface of the product.

It is therefore an objective of this invention to provide a pocketed spring comfort layer adapted to overlay a spring core of a seating or bedding product which may eliminate the need for a mattress manufacturer to place one or more foam or fiber layers above the pocketed spring comfort layer.

It is another objective of this invention to provide a pocketed spring comfort layer adapted to overlay a spring core of a seating or bedding product which may reduce the number or thickness of foam or fiber layers a mattress manufacturer may elect to place above such a pocketed spring comfort layer, thereby reducing the cost of the finished mattress by the cost of such layers and the associated cost of applying them.

It is another objective of this invention to provide a pocketed spring comfort layer adapted to overlay a spring core of a seating or bedding product which has a unique feel combining the feel of individually pocketed mini coil springs and the luxury feel for a polyurethane, visco-elastic or latex foam comfort layer.

SUMMARY OF THE INVENTION

The invention, which accomplishes these objectives, comprises a comfort layer configured to overlay spring core of a seating or bedding product. The comfort layer comprises an assembly or matrix of interconnected, individually pocketed mini coil springs, each mini coil spring being contained within a fabric pocket. The fabric pocket within which at least one mini coil spring is contained is formed by joining a cushion assembly on one side of the at least one mini coil spring and ply of conventional non-woven polypropylene material, commonly used in the bedding industry, on the other side of the at least one mini coil spring by a weld seam around the pocket. In one embodiment, the weld seam is rectangular comprising four side seams, at least one side seam comprising linear weld segments with gaps between the linear weld segments. In another embodiment, the weld seam is circular comprising curved weld segments with gaps therebetween.

In some preferred embodiments, the pocketed spring comfort layer is made with an upper cushion assembly and a lower cushion assembly. The fabric pockets comprise an upper cushion assembly and a lower cushion assembly with at least one mini coil spring therebetween in each fabric pocket. In one embodiment, each of the cushion assemblies comprises a layer of foam sandwiched between conventional non-woven polypropylene fabric, commonly used in the bedding industry. However, more than one layer of foam may be used in either cushion assembly or both cushion assemblies in any of the embodiments shown or described herein. The two cushion assemblies on opposite sides of the mini coil springs in the pocketed spring comfort layer are joined by rectangular weld seams or circular weld seams, thereby creating the fabric pockets.

Each cushion assembly includes at least one foam layer. The foam may be polyurethane, visco-elastic or latex foam, but, in most applications, the foam is polyurethane foam. In one embodiment, the cushion assembly comprises a foam layer sandwiched between two layers of conventional non-woven polypropylene material. However, the cushion assembly may include any number of layers of foam and any number of layers of other fabric materials.

Any of the embodiments of comfort layer shown or described herein may be incorporated into a bedding product, such as a mattress, foundation or pillow. Further, any of the embodiments of comfort layer shown or described herein may be incorporated into a seating product, such as a vehicle seat and/or office or residential furniture, such as a recliner. Alternatively, any of the embodiments of comfort layer shown or described herein may be sold independently as a retail or wholesale item. In such an application, the comfort layer may be added to and/or removed from a bedding or seating product by a customer.

The comfort layer of the present invention, whether incorporated inside a bedding or seating product, or manufactured and sold as a separate product, provides an additional cooling effect to the product due to airflow through the comfort layer, including between adjacent pockets.

According to another aspect of the invention, a method of manufacturing a comfort layer for a bedding or seating product is provided. The comfort layer is configured to overlay a spring core of a bedding or seating product. The method comprises forming a continuous blanket of individually pocketed springs, each spring of which is contained within a pocket formed by joining a cushion assembly and ply of fabric together. The continuous blanket of individually pocketed springs is cut to a desired size after passing through a machine, which inserts multiple springs between a cushion assembly and a ply of fabric and joins the cushion assembly and fabric ply along segmented seams around the perimeter of each of the springs in a row or group.

Another method of manufacturing a comfort layer for a bedding or seating product uses two cushion assemblies. The comfort layer is configured to overlay a spring core of a bedding or seating product. The method comprises forming a continuous blanket of individually pocketed mini coil springs, each mini coil spring of which is contained within a pocket formed by joining upper and lower cushion assemblies together. The continuous blanket of individually pocketed springs is cut to a desired size after passing through a machine, which inserts multiple mini coil springs between the cushion assemblies and joins the cushion assemblies along segmented seams around the perimeter of each of the springs in a row or group.

According to another aspect of the invention, a bedding or seating product has a core and a pocketed spring comfort layer overlaying the core. The pocketed spring comfort layer comprises a matrix of interconnected mini pocketed springs. Each mini spring is contained within a pocket of fabric between a multi-layered cushion assembly and a bottom piece of non-woven polypropylene fabric. Each pocket has a segmented weld seam around the pocket joining the multi-layered cushion assembly and the bottom piece of non-woven polypropylene fabric of the pocket. Each weld seam comprises multiple weld segments. The multi-layered cushion assembly includes at least one layer of foam. The segmented weld seam may be circular and the weld seams curved. Alternatively, the segmented weld seam may be rectangular and the weld seams linear. The core may be a spring core or foam core or any combination thereof.

According to another aspect of the invention, a bedding or seating product has a core and a pocketed spring comfort layer overlaying the core. The pocketed spring comfort layer comprises a matrix of interconnected mini pocketed springs. Each mini spring is contained within a pocket of fabric between multi-layered cushion assemblies. Each pocket has a segmented weld seam around the pocket joining the multi-layered cushion assemblies. Each weld seam comprises multiple weld segments. The multi-layered cushion assembly includes at least one layer of foam and may have at least three layers. The segmented weld seam may be circular and the weld seams curved. Alternatively, the segmented weld seam may be rectangular and the weld seams linear. The core may be a spring core or foam core or any combination thereof.

By incorporating a layer of foam into a pocketed spring comfort layer, a manufacturer of the comfort layer may create a pocketed spring comfort layer with a luxury feel in a cost-effective manner.

These and other objects and advantages of this invention will be more readily apparent from the following drawings.

BRIEF DESCRIPTION OF THE DRAWINGS

FIGS. 3AA-3EE illustrate the same manufacturing process as shown in FIGS. 3A-3E but joining two cushion assemblies instead of one cushion assembly to a ply of fabric;

DETAILED DESCRIPTION OF THE DRAWINGS

Figure 1:
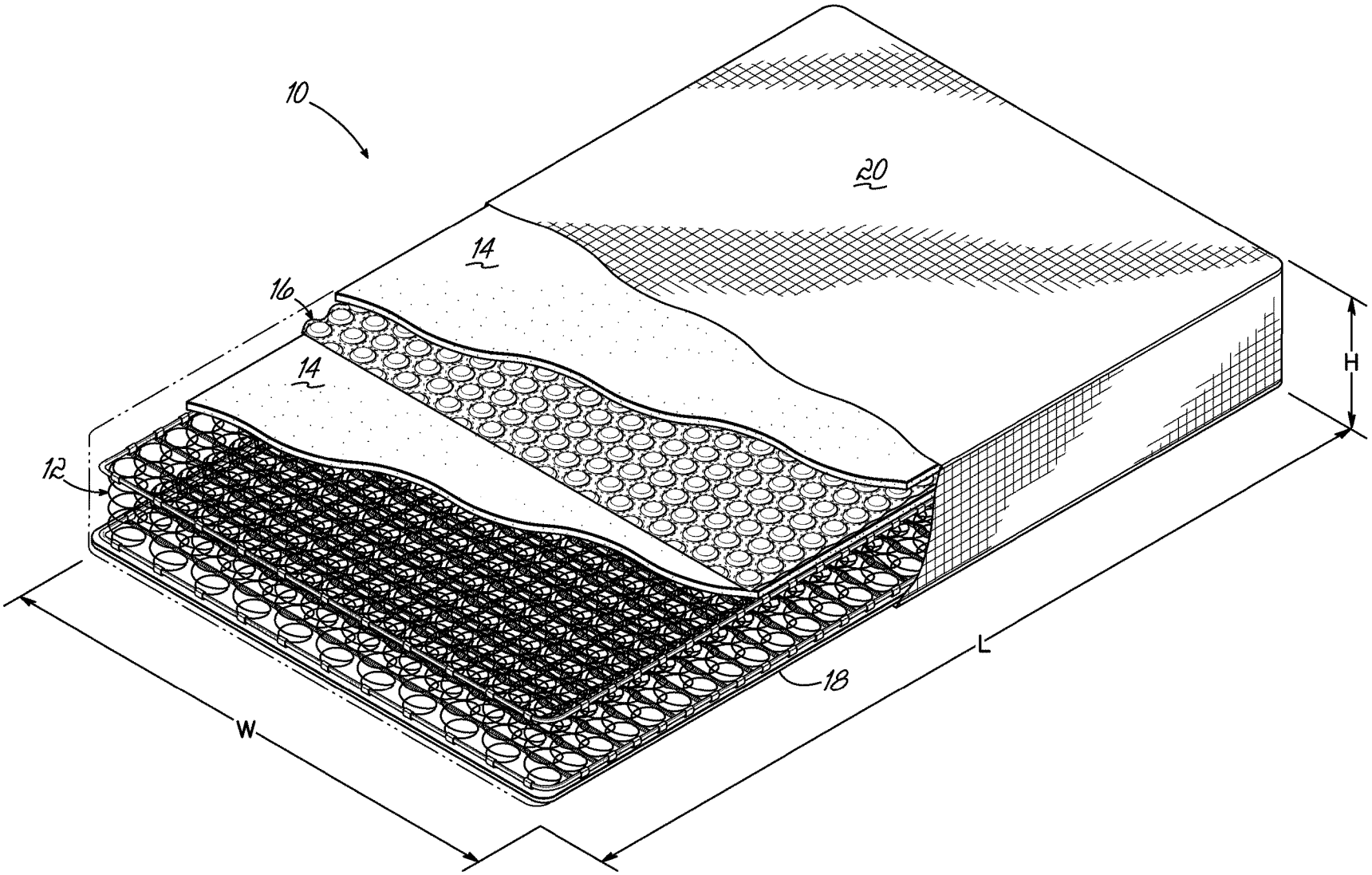
FIG. 1 is a perspective view, partially broken away, of a bedding product incorporating one of the pocketed spring comfort layers of this invention.

With reference to FIG. 1, there is illustrated a single-sided mattress 10 incorporating one embodiment of pocketed spring comfort layer in accordance with this invention. This mattress 10 comprises a spring core 12 over the top of which there is a conventional cushioning pad 14 which may be partially or entirely made of foam or fiber or gel, etc. The cushioning pad 14 may be covered by a comfort layer 16 constructed in accordance with the present invention. A second conventional cushioning pad 14 may be located above the comfort layer 16. In some applications, one or both cushioning pads 14 may be omitted. This complete assembly may be mounted upon a base 18 and is completely enclosed within an upholstered cover 20.

As shown in FIG. 1, mattress 10 has a longitudinal dimension or length L, a transverse dimension or width W and a height H. Although the length L is shown as being greater than the width W, they may be identical. The length, width and height may be any desired distance and are not intended to be limited by the drawings.

While several embodiments of pocketed spring comfort layer are illustrated and described as being embodied in a single-sided mattress, any of the pocketed spring comfort layers shown or described herein may be used in a single-sided mattress, double-sided mattress or seating cushion. In the event that any such pocketed spring comfort layer is utilized in connection with a double-sided product, then the bottom side of the product's core may have a pocketed spring comfort layer applied over the bottom side of the core and either pocketed spring comfort layer may be covered by one or more cushioning pads made of any conventional material. According to the practice of this invention, though, either the cushioning pad or pads, on top and/or bottom of the core, may be omitted. The novel features of the present invention reside in the pocketed spring comfort layer.

Although spring core 12 is illustrated being made of unpocketed coil springs held together with helical lacing wires, the core of any of the products, such as mattresses shown or described herein, may be made wholly or partially of pocketed coil springs (see FIGS. 7 and 14), one or more foam pieces (not shown) or any combination thereof. Any of the comfort layers described or shown herein may be used in any single or double-sided bedding or seating product having any conventional core. The core may be any conventional core including, but not limited to, pocketed or conventional spring cores.

Figure 4:
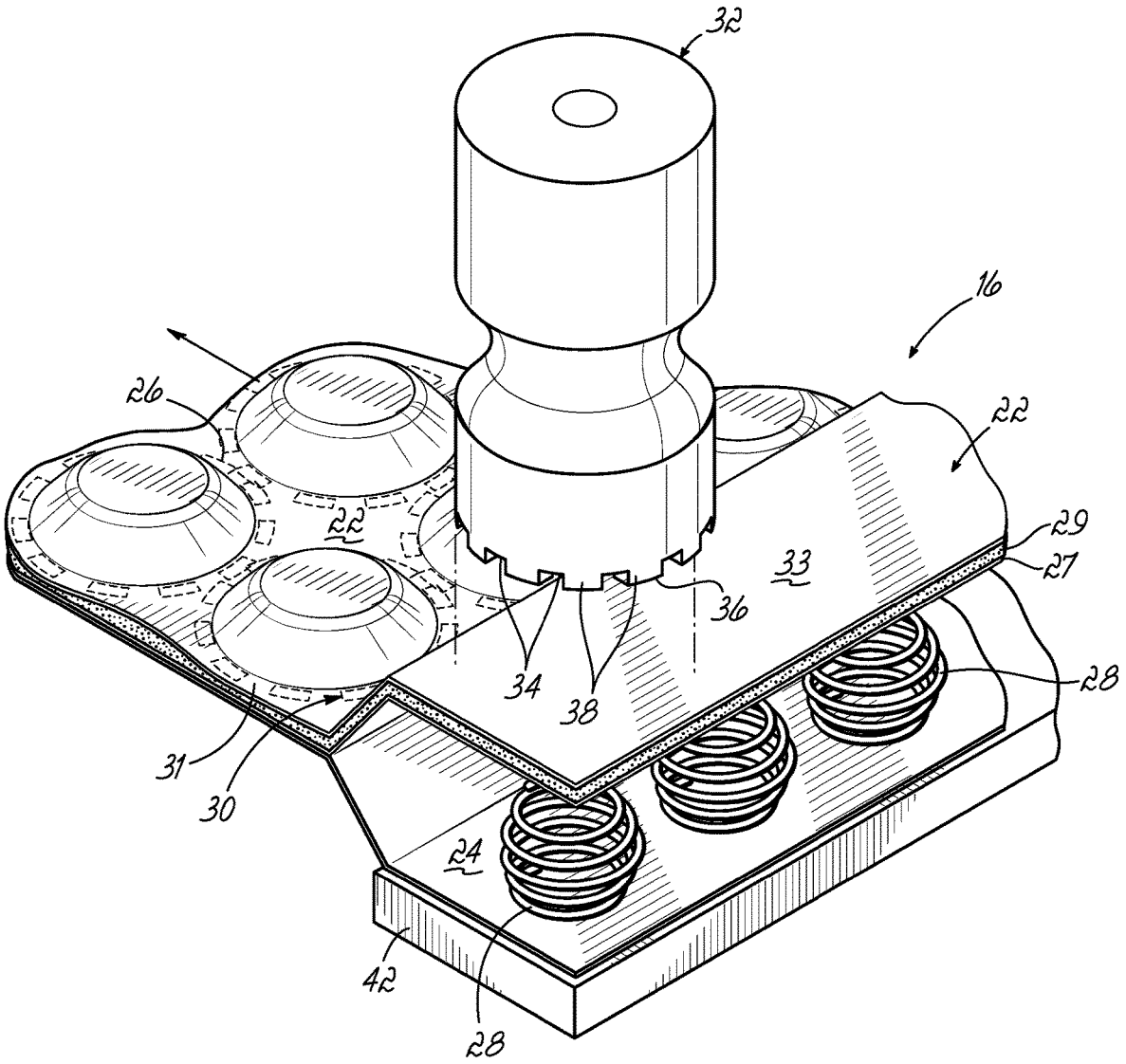
FIG. 4 is an enlarged perspective view of a portion of the pocketed spring comfort layer of FIG. 1 partially disassembled and showing a portion of a welding tool.

FIG. 4 illustrates the components of one embodiment of comfort layer 16 incorporated into the mattress 10 shown in FIG. 1. The comfort layer 16 comprises a cushion assembly 22 and a piece of fabric 24 with a plurality of mini coil springs 28 therebetween. The cushion assembly 22 and piece of fabric 24 are joined together with circular containments or seams 30, each seam 30 surrounding a mini coil spring 28. Each circular containment or seam 30 comprises multiple arced or curved weld segments 26 with gaps 31 therebetween. The cushion assembly 22 and piece of fabric 24 are joined together along each arced or curved weld segment 26 of each circular containment or seam 30. The cushion assembly 22 and piece of fabric 24 are not joined together along each gap 31 between adjacent weld segments 26 of each circular containment or seam 30. The curved weld segments 26 are strategically placed around a mini coil spring 28 and create the circular containment or seam 30. The cushion assembly 22 and piece of fabric 24, in combination with one of the the circular weld seams 30, define a cylindrical-shaped pocket 44, inside of which is at least one resilient member such as a mini coil spring 28. See FIGS. 5 and 5A.

During the welding process, the mini coil springs 28 may be at least partially compressed before pocket 44 is closed and thereafter. If desired, resilient members other than mini coil springs, such as foam or plastic or gel or a combination thereof, may be used. Each of the resilient members may return to its original configuration after a load is removed from the pockets in which the resilient members are located.

Figure 5:
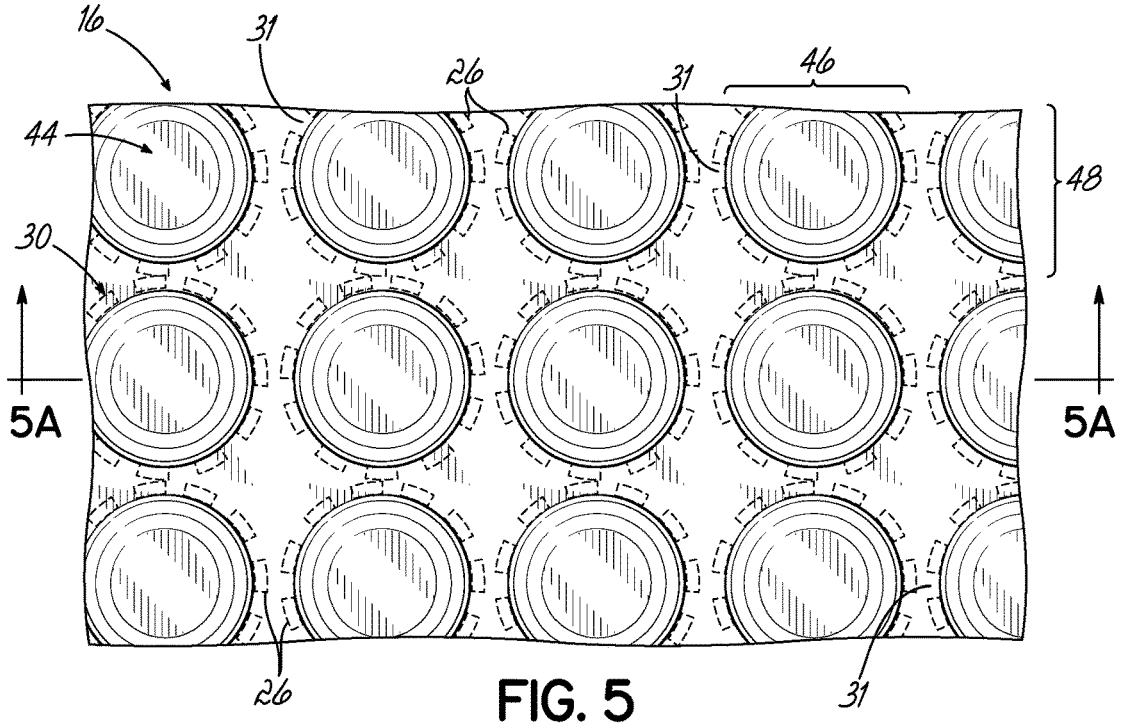
FIG. 5 is a top plan view of a portion of the pocketed spring comfort layer of FIG. 1.
Figure 5A:
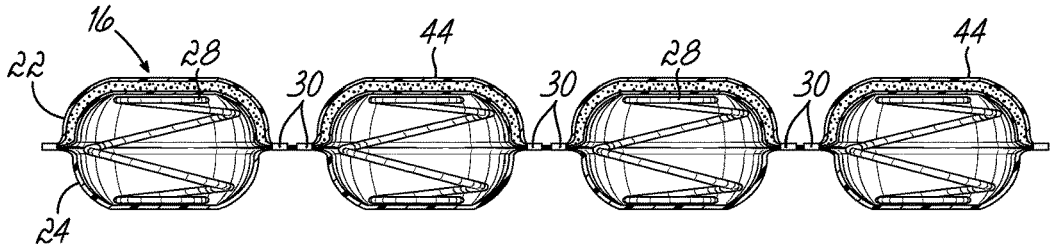
FIG. 5A is a cross-sectional view taken along the line 5A-5A of FIG. 5.
Figure 6:
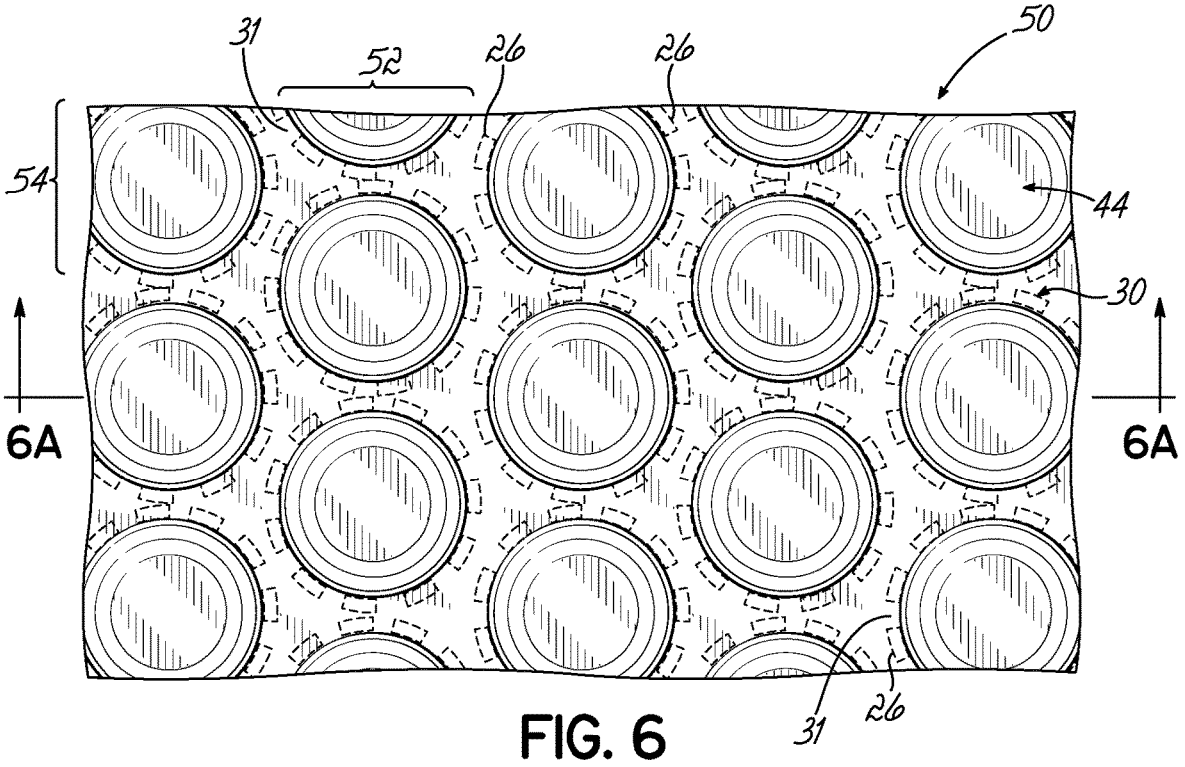
FIG. 6 is a top plan view of a portion of another pocketed spring comfort layer showing the pockets offset rather than aligned.
Figure 6A:
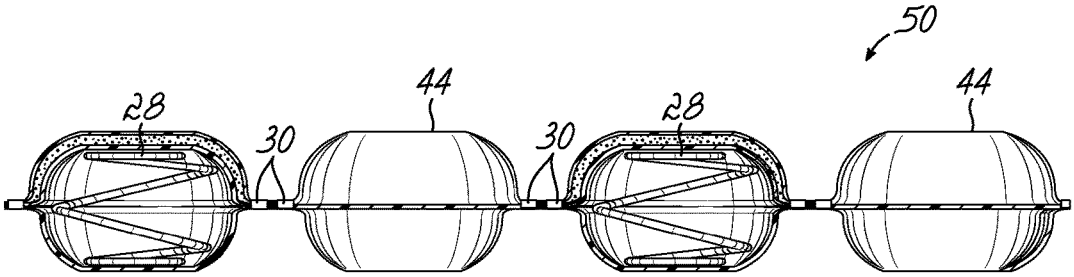
FIG. 6A is a cross-sectional view taken along the line 6A-6A of FIG. 6.

The size of the curved weld segments 26 of seams 30 are not intended to be limited by the illustrations; they may be any desired size depending upon the airflow desired inside the comfort layer. Similarly, the size, i.e., diameter of the illustrated seams 30, is not intended to be limiting. The placement of the seams 30 shown in the drawings is not intended to be limiting either. For example, the seams 30 may be organized into aligned rows and columns, as shown in FIGS. 5 and 5A or organized with adjacent columns being offset from each other, as illustrated in FIGS. 6 and 6A. Any desired arrangement of seams may be incorporated into any embodiment shown or described herein.

The weld segments may assume shapes other than the curved weld segments illustrated. For example, the welds or seams may be circular around mini coil springs, but the weld segments may assume other shapes, such as triangles or circles or ovals of the desired size and pattern.

In any of the embodiments shown or described herein, the mini coil springs 28 may be any desired size. One mini coil spring in a relaxed condition may be approximately two inches tall, have a diameter of approximately three inches and be made of seventeen and one-half gauge wire. While compressed inside one of the pockets 44, each of the mini coil springs 28 may be approximately one and one-half inches tall. However, the mini coil springs 28 in a relaxed condition may be any desired height, have any desired shape, such as an hourglass or barrel shape, have any desired diameter and/or be made of any desired wire thickness or gauge.

Figure 5B:
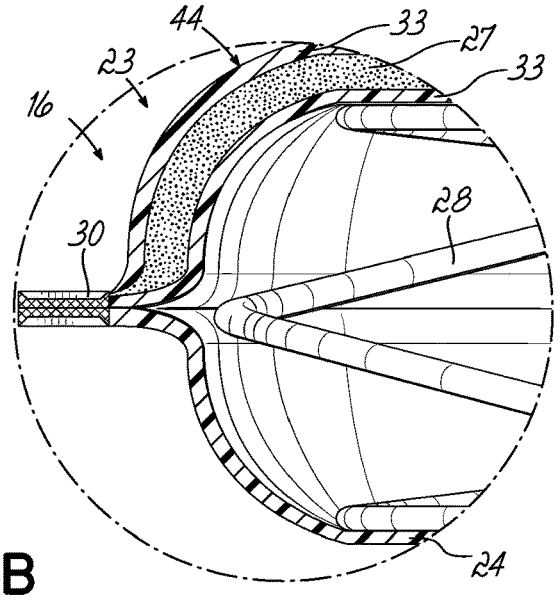
FIG. 5B is an enlarged cross-sectional view of a portion of the pocketed spring comfort layer of FIG. 1.

As shown in FIGS. 4 and 5B, in one embodiment the cushion assembly 22 may be a three-layered fabric permeable to airflow. The cushion assembly 22 comprises three layers, including from the inside moving outwardly: 1) a protective layer of non-woven polypropylene fabric 27; 2) a middle layer of polyurethane foam 29; and 3) an outer layer of non-woven polypropylene fabric 33. More specifically, the inner protective layer of fabric 27 may be a non-woven polypropylene fabric having a density between 0.75 to 3.0 ounces per square yard. The middle foam layer 29 may be a polyurethane foam layer having a thickness of approximately 0.25 to 2 inches and a density in the range of 1.0 to 4.0 pounds per cubic foot. In the event the middle foam layer 29 is viscoelastic foam, its density would preferably be between 1.0 and 6.0 pounds per cubic foot. The outer layer 33 may be a non-woven polypropylene fabric having a density between 0.75 to 3.0 ounces per square yard.

The bottom protective layer of fabric 24 which forms the bottom side of pocket 44 may be a non-woven polypropylene fabric having a density between 0.75 to 3.0 ounces per square yard. These materials and material specifications, such as the densities provided for the outer layers, have proven to be effective, but are not intended to be limiting.

With reference to FIG. 4, there is illustrated a portion of a mobile ultrasonic welding horn 32 and anvil 42. The movable ultrasonic welding horn 32 has a plurality of spaced cut-outs or slots 34 along its lower edge 36. The remaining portions 38 of the ultrasonic welding horn's bottom 36 between the slots 34 are the portions which weld the cushion assembly 22 and piece of fabric 24 together and create the curved weld segments 26. Along the ultrasonic welding horn's bottom edge 36, the ultrasonic welding horn 32 can be milled to make the slots a desired length to allow a desired airflow between the curved weld segments 26.

As shown in FIG. 4, underneath the second ply 24 is an anvil 42 comprising a steel plate of ⅜$^{th}$ inch thickness. However, the anvil may be any desired thickness. During the manufacturing process, the ultrasonic welding horn 32 contacts the anvil 42, the cushion assembly 22 and piece of fabric 24 therebetween, to create the circular weld seams 30 and hence, cylindrical-shaped pockets 44, at least one spring being in each pocket 44.

These curved weld segments 26 are created by the welding horn 32 of a machine (not shown) having multiple spaced protrusions 38 on the ultrasonic welding horn 32. As a result of these circular weld seams 30 joining cushion assembly 22 and piece of fabric 24, the cushion assembly 22 and piece of fabric 24 define a plurality of spring-containing pockets 44 of the comfort layer 16. One or more mini coil springs 28 may be contained within an individual pocket 44.

Figure 4A:
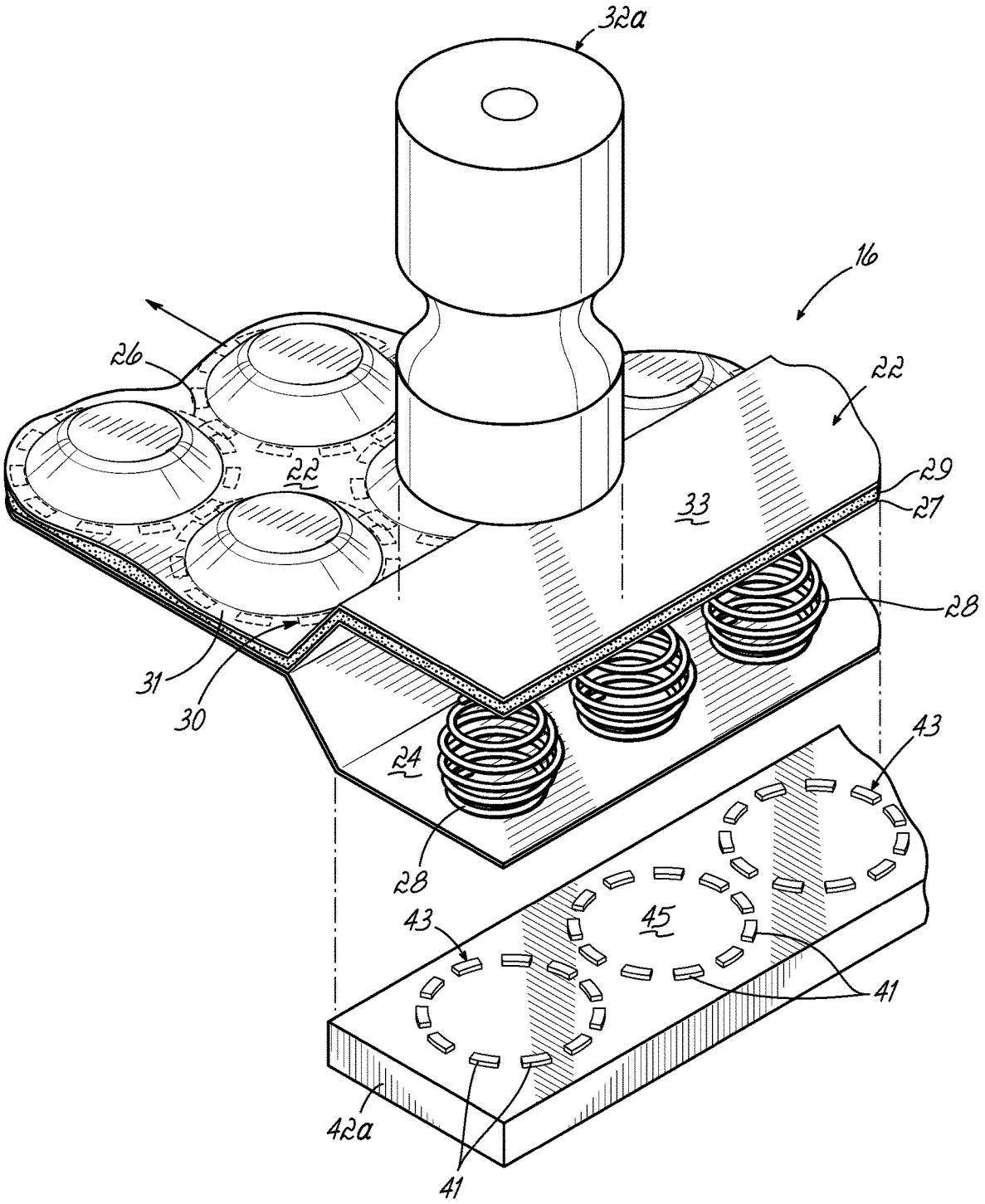
FIG. 4A is an enlarged perspective view of a portion of the pocketed spring comfort layer of FIG. 1 partially disassembled and showing a portion of another welding tool.

FIG. 4A illustrates another apparatus for forming the circular weld seams 30 comprising multiple curved weld segments 26 having gaps 31 therebetween. In this apparatus, the ultrasonic welding horn 32*a* has no protrusions on its bottom surface 39. Instead, the bottom surface 39 of ultrasonic welding horn 32*a* is smooth. As shown in FIG. 4A, the anvil 42*a* has a plurality of curved projections 41, which together form a projection circle 43. A plurality of projection circles 43 extend upwardly from the generally planar upper surface 45 of anvil 42*a*. When the ultrasonic welding horn 32*a* moves downwardly and sandwiches the cushion assembly 22 and piece of fabric 24 between one of the projection circles 43 and the smooth bottom surface 39 of ultrasonic welding horn 32*a*, a circular weld seam 30 is created, as described above. Thus, a plurality of pockets 44 are created by the circular weld seams 30, each pocket 44 containing at least one mini coil spring 28.

As best illustrated in FIG. 5, the individual pockets 44 of comfort layer 16 may be arranged in longitudinally extending columns 46 extending from head-to-foot of the bedding product and transversely extending rows 48 extending from side-to-side of the bedding product. As shown in FIGS. 5 and 5A, the individual pockets 44 of one column 46 are aligned with the pockets 44 of adjacent columns 46.

FIGS. 6 and 6A illustrate another comfort layer 50 having the same pockets 44 and same mini coil springs 28 as does the embodiment of comfort layer 16 of FIGS. 1-5A. As best illustrated in FIG. 6, the individual pockets 44 of comfort layer 50 are arranged in longitudinally extending columns 52 extending from head-to-foot of the bedding product and transversely extending rows 54 extending from side-to-side of the bedding product. As shown in FIGS. 6 and 6A, the individual pockets 44 of one column 52 are offset from, rather than aligned with, the pockets 44 of the adjacent columns 52.

Figure 7:
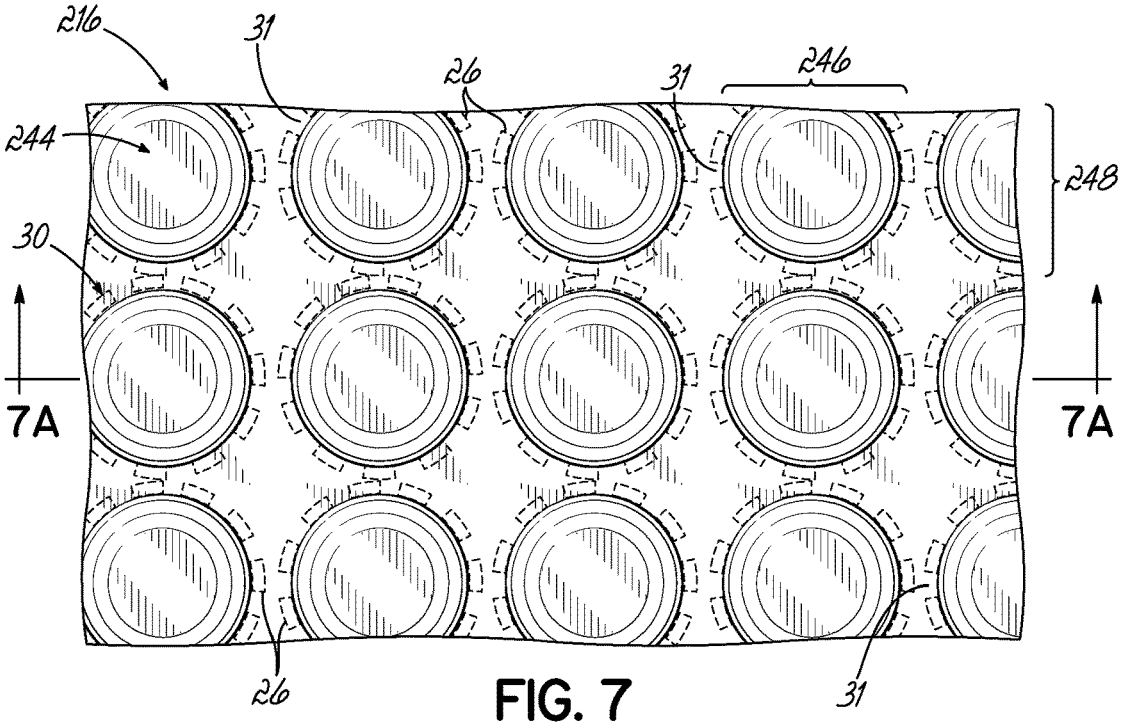
FIG. 7 is a top plan view of a portion of another pocketed spring comfort layer in accordance with the present invention.
Figure 7A:
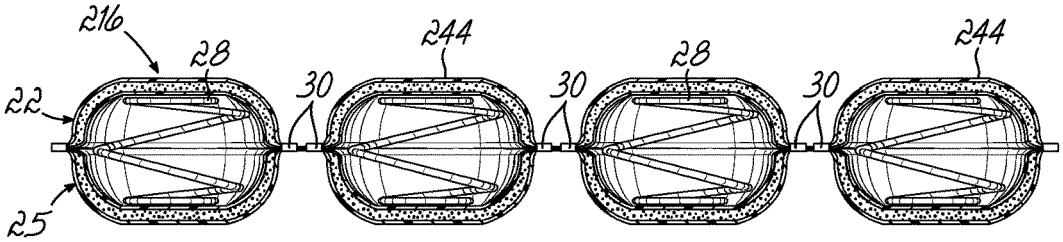
FIG. 7A is a cross-sectional view taken along the line 7A-7A of FIG. 7.
Figure 7B:
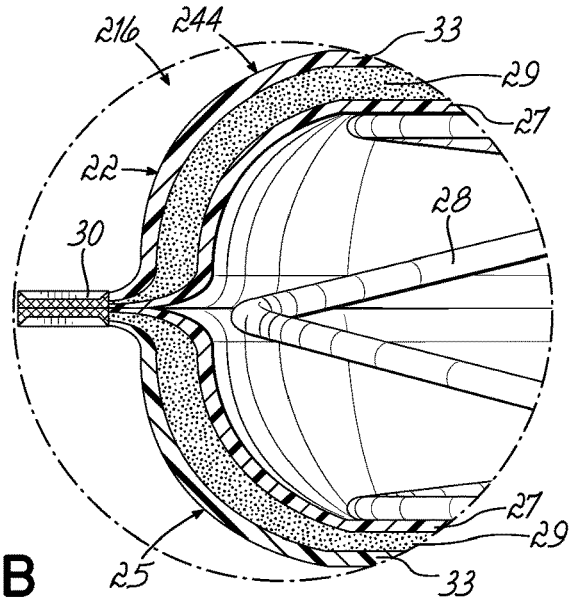
FIG. 7B is an enlarged cross-sectional view of a portion of the pocketed spring comfort layer of FIG. 7.

FIGS. 7, 7A and 7B illustrate another comfort layer 216 having the same mini coil springs 28 as does the embodiment of comfort layer 16 of FIGS. 1-5A but different pockets 244. As best illustrated in FIG. 7, the individual pockets 244 of comfort layer 216 are arranged in longitudinally extending columns 246 extending from head-to-foot of the bedding product and transversely extending rows 248 extending from side-to-side of the bedding product. As shown in FIGS. 7A and 7B, the individual pockets 244 are made with two cushion assemblies 22, 25, one being on each side of the individual pockets 244 of the comfort layer 216.

Figure 8:
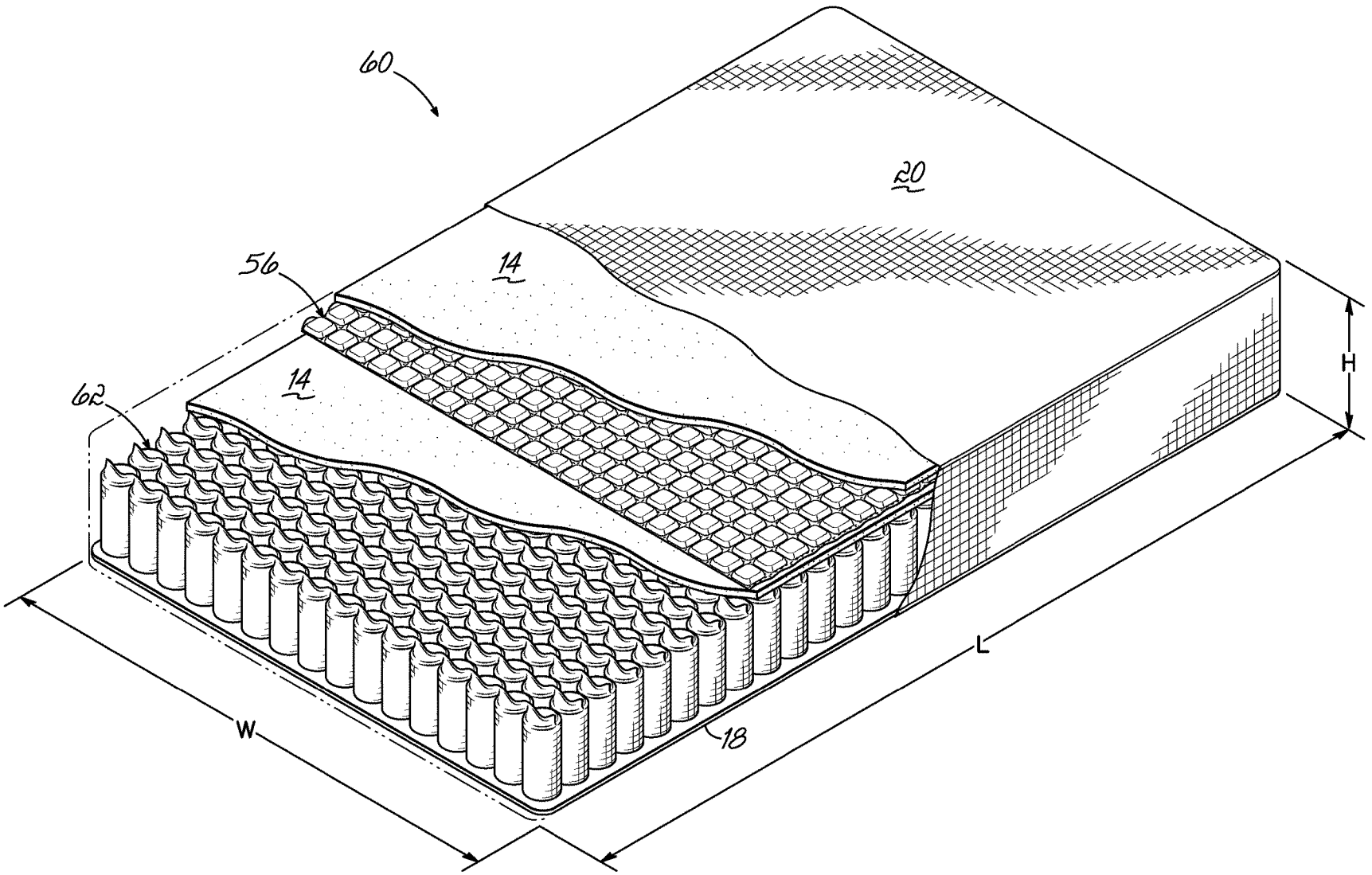
FIG. 8 is a perspective view, partially broken away, of a bedding product incorporating another embodiment of pocketed spring comfort layer in accordance with the present invention.

FIG. 8 illustrates an alternative embodiment of comfort layer 56 incorporated into a single-sided mattress 60. Single-sided mattress 60 comprises a pocketed spring core 62, a cushioning pad 14 on top of the pocketed spring core 62, a base 18, another cushioning pad 14 above comfort layer 56, and an upholstered covering material 20. Pocketed spring core 62 may be incorporated into any bedding or seating product, including a double-sided mattress, and is not intended to be limited to single-sided mattresses. As described above, comfort layer 56 may be used in any conventional core, including a foam core, a spring core made with pocketed springs or non-pocketed conventional springs.

As shown in FIG. 8, mattress 60 has a longitudinal dimension or length L, a transverse dimension or width W and a height H. Although the length L is shown as being greater than the width W, they may be identical. The length, width and height may be any desired distance and are not intended to be limited by the drawings.

Figure 10:
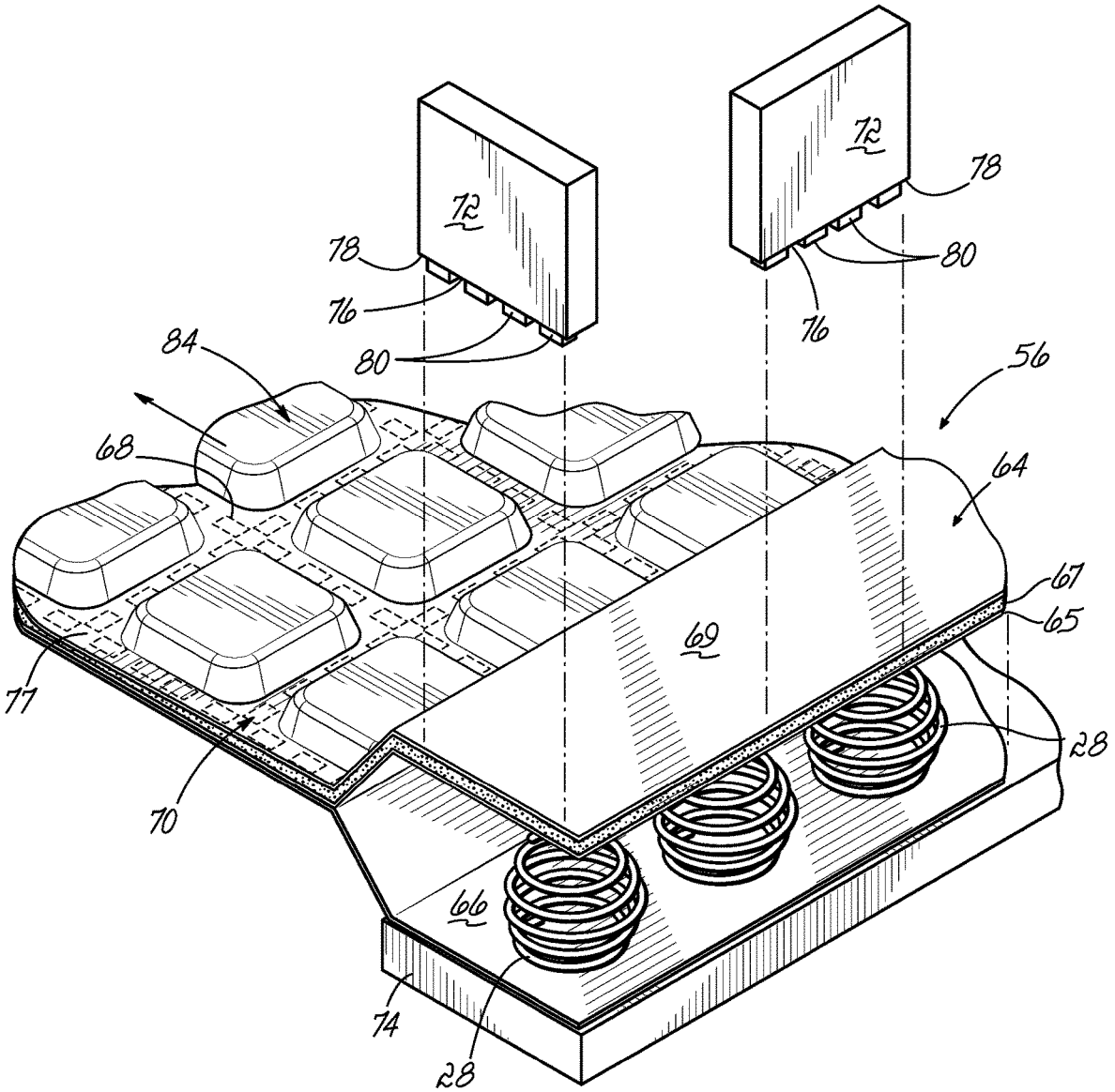
FIG. 10 is an enlarged perspective view of a portion of the pocketed spring comfort layer of FIG. 8 partially disassembled and showing a portion of a welding tool.

FIG. 10 illustrates the components of the comfort layer 56 incorporated into the mattress 60 shown in FIG. 8. The comfort layer 56 comprises a first cushion assembly 64 and a lower ply of fabric 66 joined together with multiple linear weld segments 68. These weld segments 68 are strategically placed around a mini coil spring 28 and create a rectangular containment or seam 70. During the welding process, the mini coil springs 28 may be compressed. The length and/or width of the linear weld segments 68 of seams 70 is not intended to be limited to those illustrated; they may be any desired size. Similarly, the size of the illustrated seams 70 is not intended to be limiting. Shapes other than linear weld segments may be used to create rectangular seams. Such shapes may include, but are not limited to, triangles or circles or ovals of any desired size and pattern.

Figure 11:
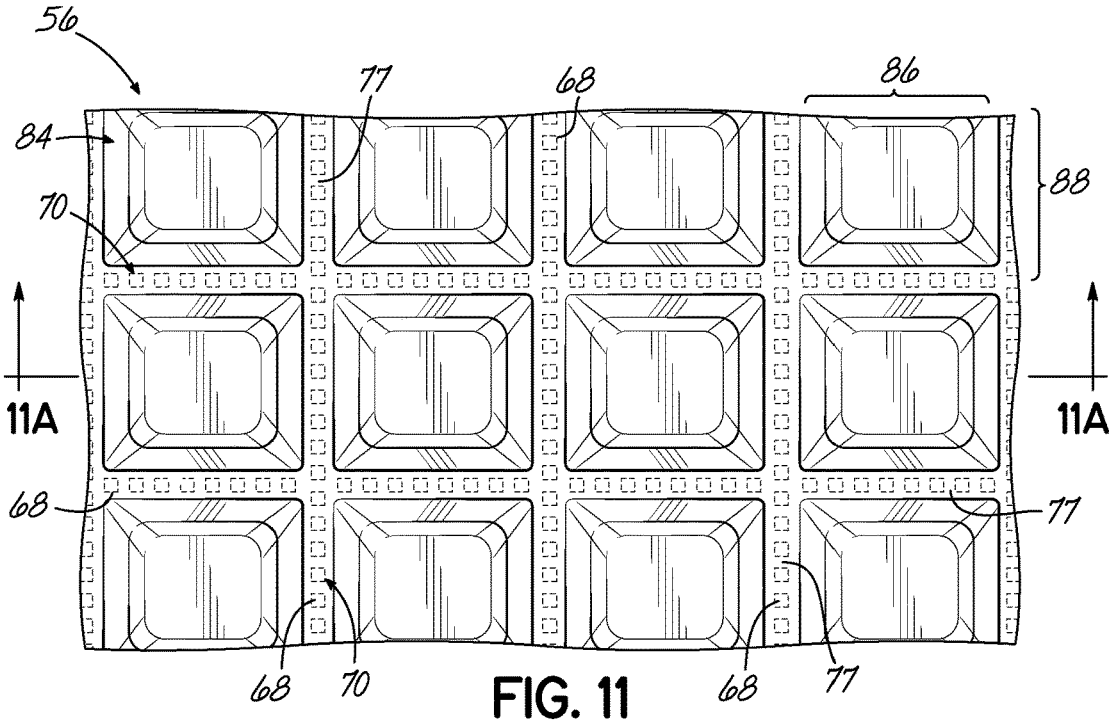
FIG. 11 is a top plan view of a portion of the pocketed spring comfort layer of FIG. 8.
Figure 11A:
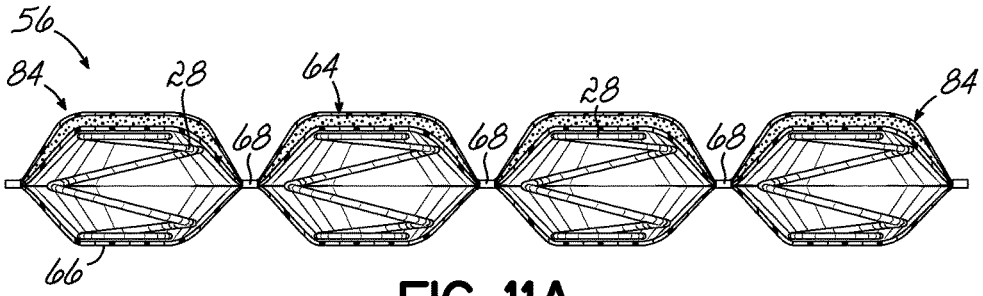
FIG. 11A is a cross-sectional view taken along the line 11A-11A of FIG. 11.
Figure 11B:
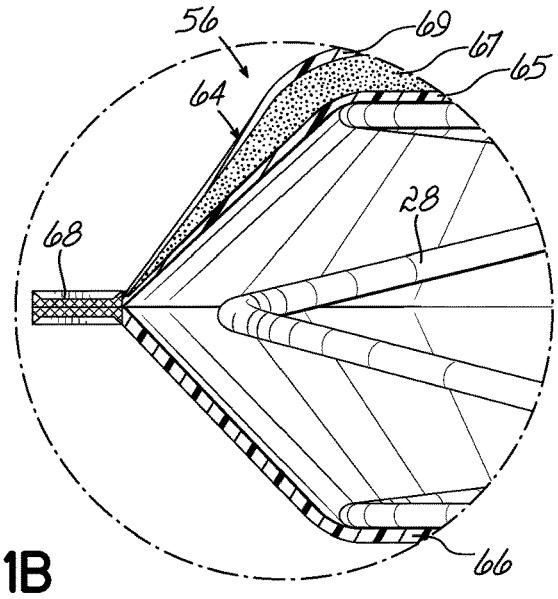
FIG. 11B is an enlarged cross-sectional view of a portion of the pocketed spring comfort layer of FIG. 8.

As shown in FIGS. 10 and 11B, in one embodiment the cushion assembly 64 may be a three-layered fabric permeable to airflow. The cushion assembly 64 comprises three layers, including from the inside moving outwardly: 1) a protective layer of non-woven polypropylene fabric 65; 2) a middle layer of polyurethane foam 67; and 3) an outer layer of non-woven polypropylene fabric 69. More specifically, the inner protective layer of fabric 65 may be a non-woven polypropylene fabric having a density between 0.75 to 3.0 ounces per square yard. The middle foam layer 67 may be a polyurethane foam layer having a thickness of approximately 0.25 to 2 inches and a density in the range of 1.0 to 4.0 pounds per cubic foot. In the event the middle foam layer 67 is viscoelastic foam its density would preferably be between 1.0 and 6.0 pounds per cubic foot. The outer layer 69 may be a non-woven polypropylene fabric having a density between 0.75 to 3.0 ounces per square yard.

The bottom protective layer of fabric 66 which forms the bottom side of pocket 84 may be a non-woven polypropylene fabric having a density between 0.75 to 3.0 ounces per square yard. These materials and material specifications, such as the densities provided for the outer layers, have proven to be effective, but are not intended to be limiting.

With reference to FIG. 10, there is illustrated a portion of an ultrasonic welding horn 72 and anvil 74. The mobile or movable ultrasonic welding horn 72 has a plurality of spaced cut-outs or slots 76 between projections 80. The projections 80 of the ultrasonic welding horn 72 are the portions which weld the cushion assembly 64 and the piece of fabric 66 together and create the linear weld segments 68 in rectangular weld seams 70. Along the ultrasonic welding horn's lower portion 78, the ultrasonic welding horn 72 can be milled to allow a desired gap between the linear weld segments 68.

As shown in FIG. 10, underneath the second ply 66 is an anvil 74 comprising a steel plate of ⅜$^{th}$ inch thickness. However, the anvil may be any desired thickness. During the manufacturing process, the ultrasonic welding horn 72 contacts the anvil 74, the cushion assembly 64 and the lower ply of fabric 66 being therebetween, to create the rectangular weld seams 70 and, hence, pockets 84, at least one mini coil spring 28 being in each pocket 84. See FIGS. 10 and 10A.

These linear weld segments 68 may be created by the welding horn 72 of a machine (shown in FIG. 10 and described below) having multiple spaced protrusions 80 on the ultrasonic welding horn 72. As a result of these rectangular weld seams 70 defining the spring-containing pockets 84 of the comfort layer 56, each mini coil spring 28 is contained within its own individual pocket 84.

Figure 10A:
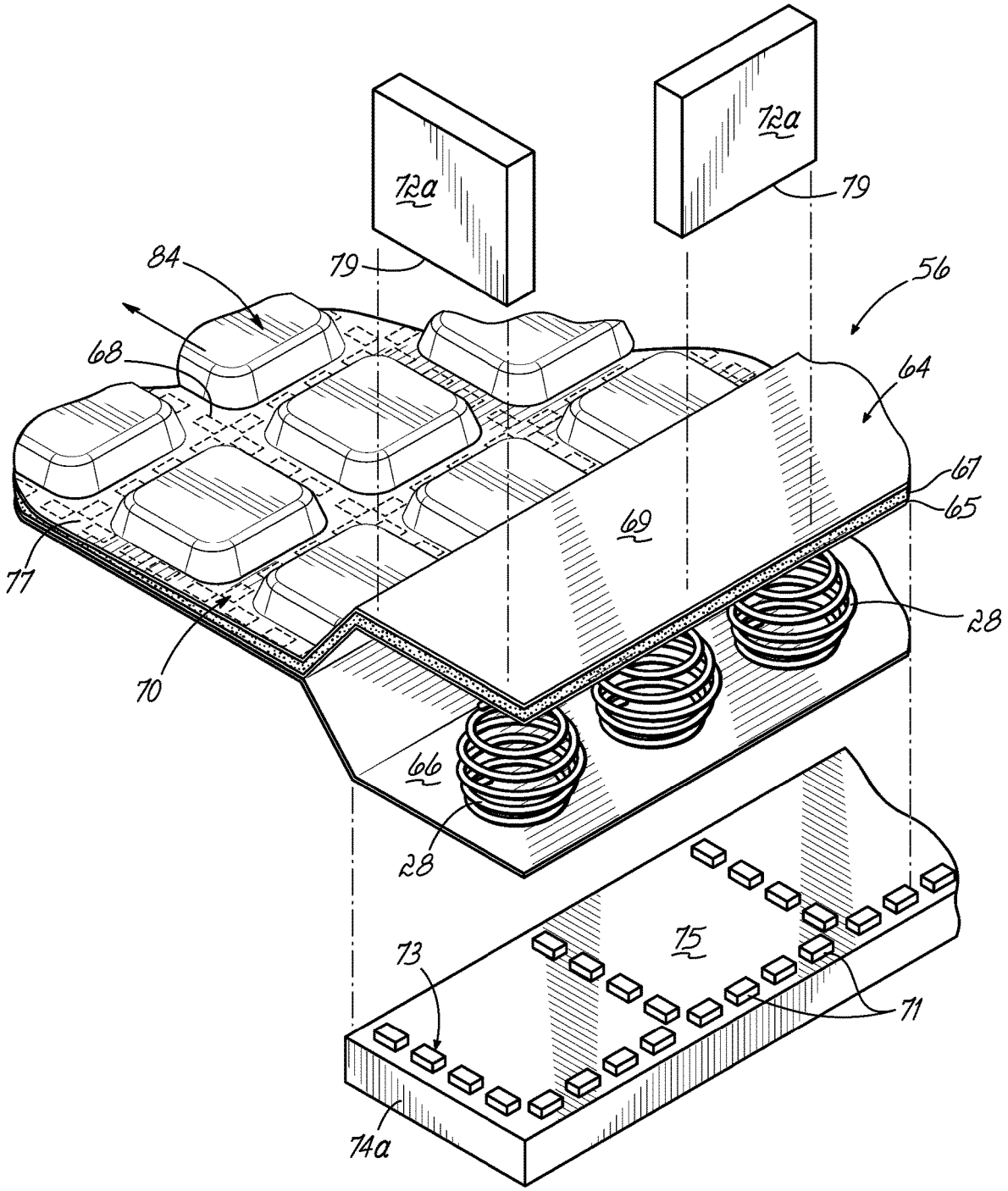
FIG. 10A is an enlarged perspective view of a portion of the pocketed spring comfort layer of FIG. 8 partially disassembled and showing a portion of another welding tool.

FIG. 10A illustrates another apparatus for forming the rectangular weld seams 70 comprising multiple linear weld segments 68 having gaps 77 therebetween for airflow. In this apparatus, the ultrasonic welding horn 72*a* has no protrusions on its bottom surface 79. Instead, the bottom surface 79 of ultrasonic welding horn 72*a* is smooth. The anvil 74*a* has a plurality of linear projections 71, which together form a projection pattern 73, shown in FIG. 10A. A plurality of spaced projections 71 in pattern 73 extend upwardly from the generally planar upper surface 75 of anvil 74*a*. When the ultrasonic welding horn 72*a* moves downwardly and sandwiches the cushion assembly 64 and lower ply of fabric 66 between the projections 71 and the smooth bottom surface 79 of ultrasonic welding horn 72*a*, rectangular weld seams 70 are created. Thus, a plurality of pockets 84 are created by the rectangle weld seams 70, each pocket 84 containing at least one mini coil spring 28.

As best illustrated in FIG. 11, the individual pockets 84 of comfort layer 56 may be arranged in longitudinally extending columns 86 extending from head-to-foot of the bedding product and transversely extending rows 88 extending from side-to-side of the bedding product. As shown in FIGS. 11 and 11A, the individual pockets 84 of one column 86 are aligned with the pockets 84 of the adjacent columns 86.

Figure 12:
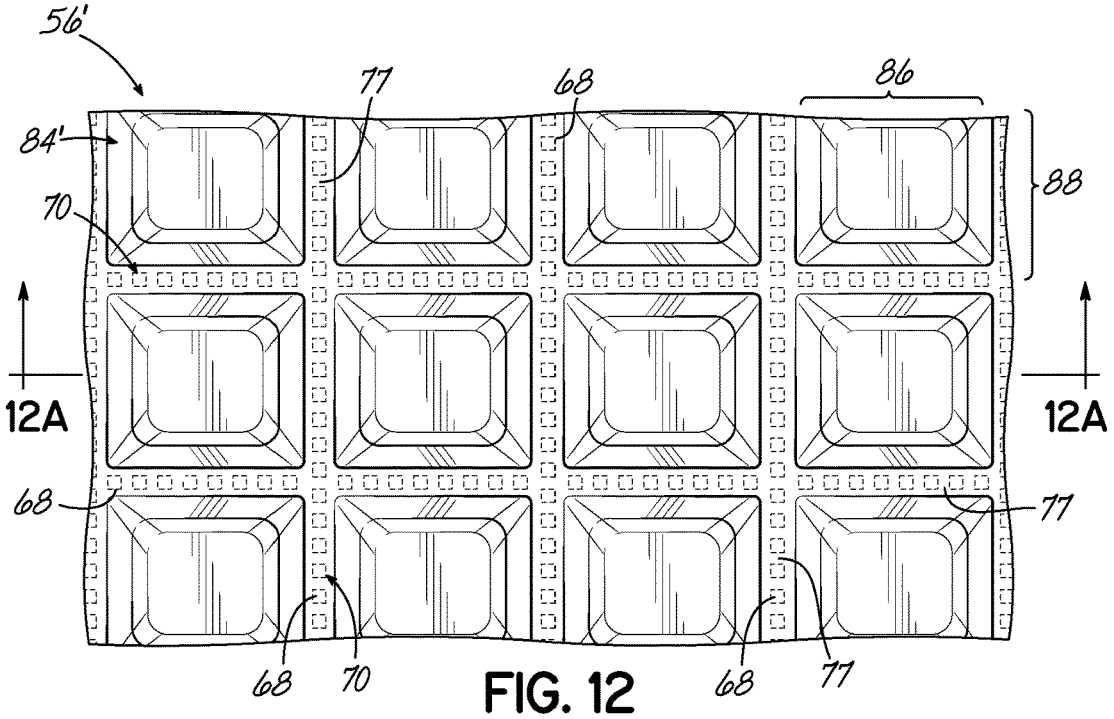
FIG. 12 is a top plan view of a corner portion of the pocketed spring comfort layer of FIG. 8.
Figure 12A:
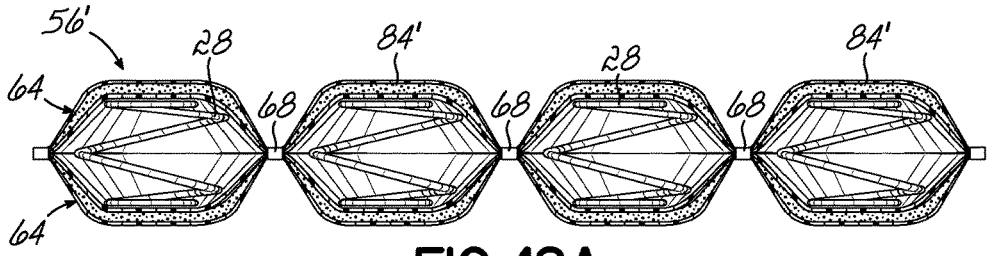
FIG. 12A is a cross-sectional view taken along the line 12A-12A of FIG. 12.
Figure 12B:
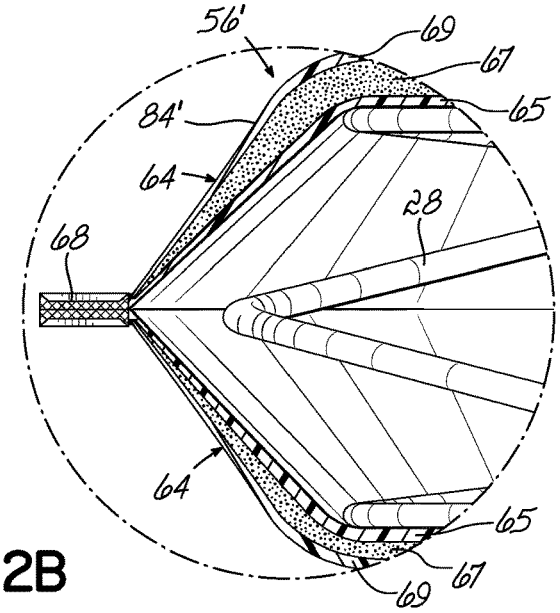
FIG. 12B is an enlarged cross-sectional view of a portion of the pocketed spring comfort layer of FIG. 12.

FIGS. 12, 12A and 12B illustrate another comfort layer 56' having the same mini coil springs 28 as does the embodiment of comfort layer 56 of FIGS. 11-11B, but different pockets 84'. As best illustrated in FIG. 12, the individual pockets 84' of comfort layer 56' are arranged in longitudinally extending columns 86 extending from head-to-foot of the bedding product and transversely extending rows 88 extending from side-to-side of the bedding product. As shown in FIGS. 12A and 12B, the individual pockets 84' are made with two cushion assemblies 64, one being on each side of the individual pockets 84' of the comfort layer 56'.

Figure 13:
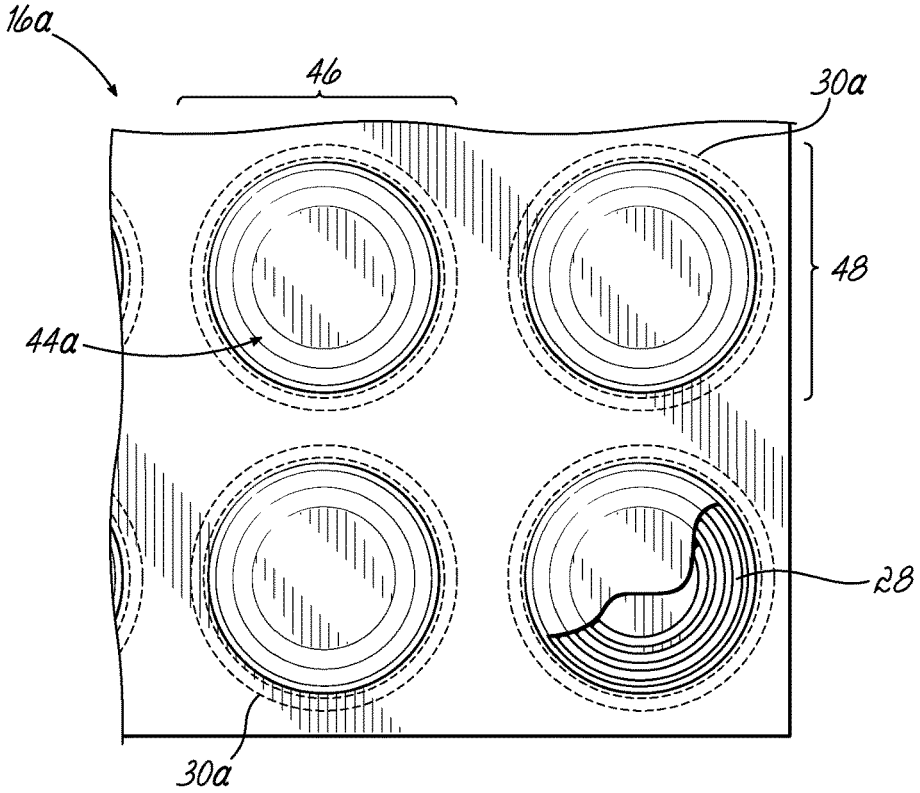
FIG. 13 is a top plan view of a corner portion of another embodiment of pocketed spring comfort layer.

FIG. 13 illustrates one corner of an alternative embodiment of comfort layer 16*a*, which may be used in any bedding or seating product. The comfort layer 16*a* comprises aligned rows 48 and columns 46 of pockets 44*a*, each pocket 44*a* comprising a circular seam 30*a* joining either one cushion assembly to one ply or two cushion assemblies together, as described above. However, each of the circular seams 30*a* is a continuous seam, as opposed to a seam having curved weld segments with gaps therebetween. These circular seams 30*a* of pockets 44*a* allow no airflow through the seams 30*a*. Therefore, the fabric material of the cushion assemblies and plies of fabric of pockets 44*a* of comfort layer 16*a* must be made of permeable material to allow airflow into and out of the pockets 44*a* of comfort layer 16*a*. The type of material used for comfort layer 16*a* allows air to enter the comfort layer 16*a* when a user gets off the bedding or seating product, thus allowing the springs 28 in the pockets 44*a* to expand and air to flow into the comfort layer 16*a*. Similarly, when a user gets onto a bedding or seating product, the springs 28 compress and cause air to exit the pockets 44*a* of the comfort layer 16*a* and exit the comfort layer. The amount of air exiting the comfort layer 16*a* affects the feel/compression of the individually pocketed mini coil springs 28 when a user lays on the product incorporating the comfort layer 16*a*.

Figure 13A:
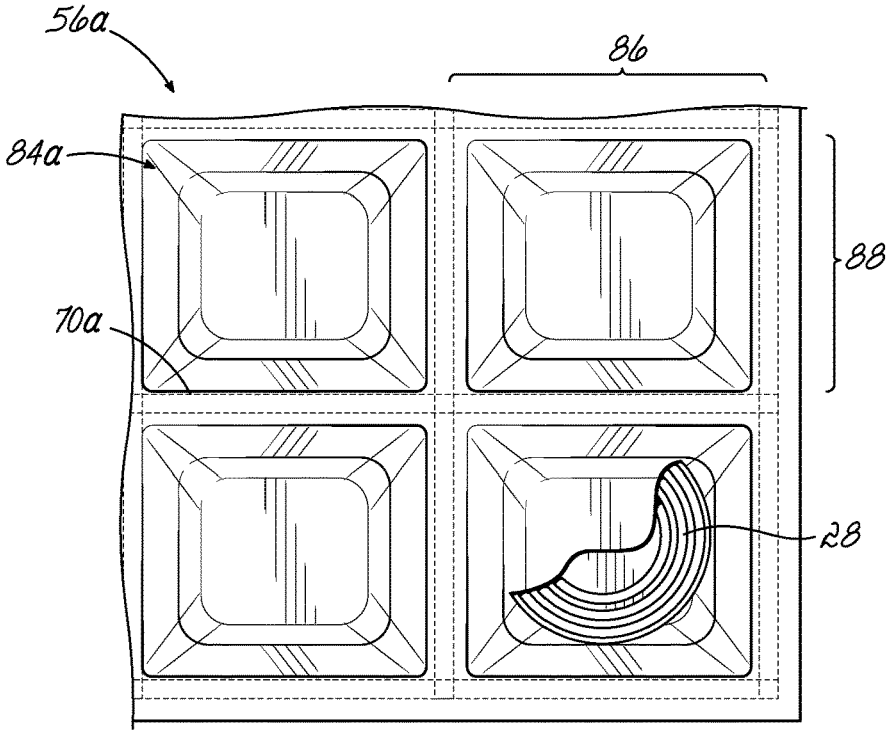
FIG. 13A is a top plan view of a corner portion of another embodiment of pocketed spring comfort layer.

FIG. 13A illustrates one corner of an alternative embodiment of comfort layer 56*a*, which may be used in any bedding or seating product. The comfort layer 56*a* comprises aligned rows 88 and columns 86 of pockets 84*a*, each pocket 84*a* comprising a rectangular seam 70*a* joining upper and lower plies of fabric as described above. However, each of the rectangular seams 70*a* is a continuous seam, as opposed to a seam having weld segments with gaps therebetween to allow airflow through the seam. These rectangular seams 70*a* of pockets 84*a* allow no airflow through the seams 70*a*. Therefore, the fabric material of the cushion assemblies and plies of pockets 84*a* of comfort layer 56*a* must be made of permeable material to allow some airflow into and out of the pockets 84*a* of comfort layer 56*a*. The type of material used for comfort layer 56*a* solely controls the amount of air entering the comfort layer 56*a* when a user gets off the bedding or seating product, thus allowing the springs 28 in the pockets 84*a* to expand and air to flow into the comfort layer 56*a*. Similarly, when a user gets onto a bedding or seating product, the springs 28 compress and cause air to exit the pockets 84*a* of the comfort layer 56*a* and exit the comfort layer.

Figure 2:
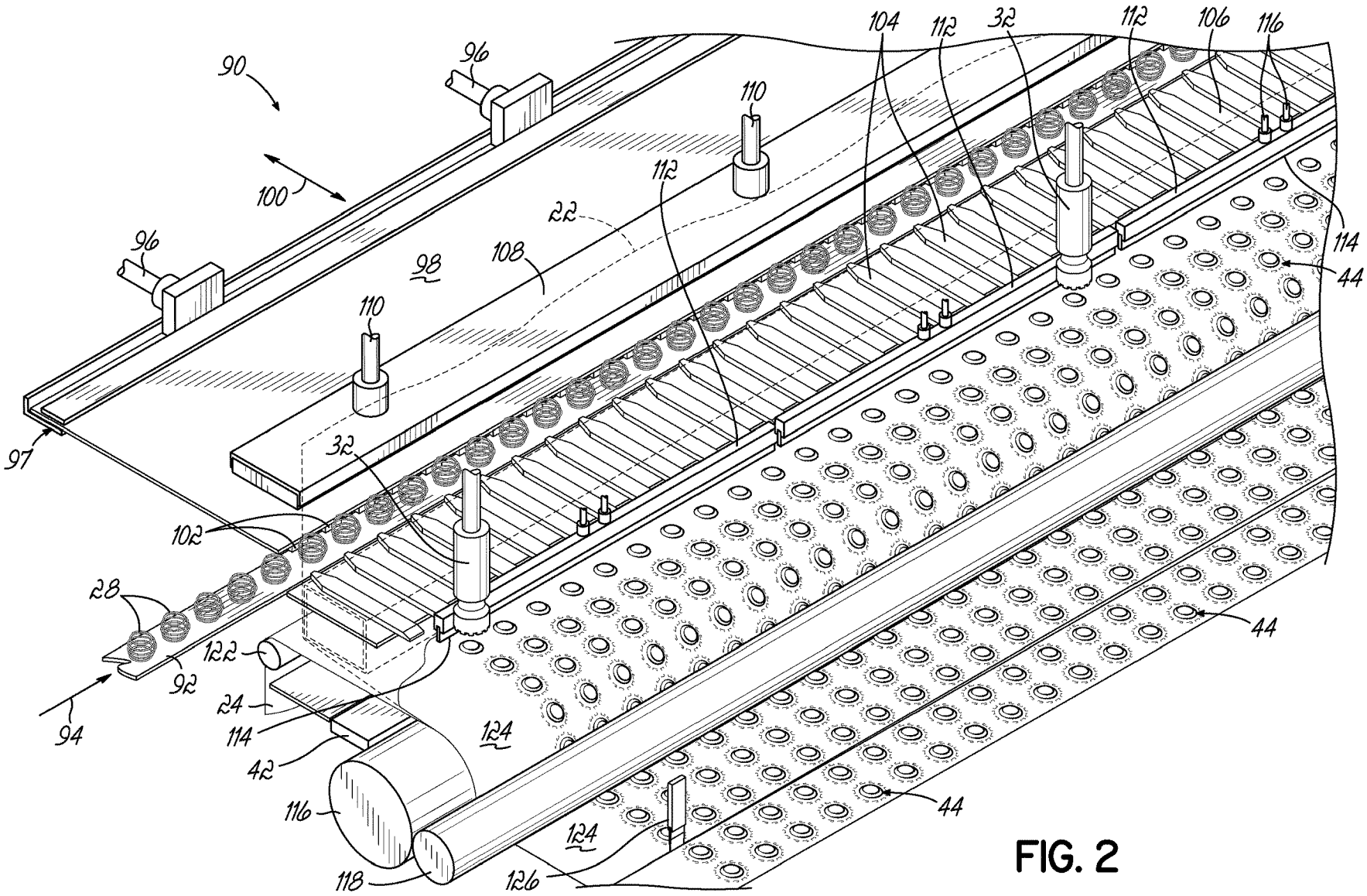
FIG. 2 is a perspective view of the pocketed spring comfort layer of FIG. 1 being manufactured.

FIG. 2 illustrates a machine 90 used to make several of the comfort layers shown and disclosed herein, including comfort layer 16 shown in FIG. 1. Some parts of the machine 90 may be changed to make other comfort layers shown or described herein, such as comfort layer 56 shown in FIG. 8. Machine 90 comprises a pair of ultrasonic welding horns 32, and at least one stationary anvil 42, as shown in FIG. 4. Alternatively, ultrasonic welding horns 32*a* and anvil 42*a* of FIG. 4A may be used in the machine.

Figure 2A:
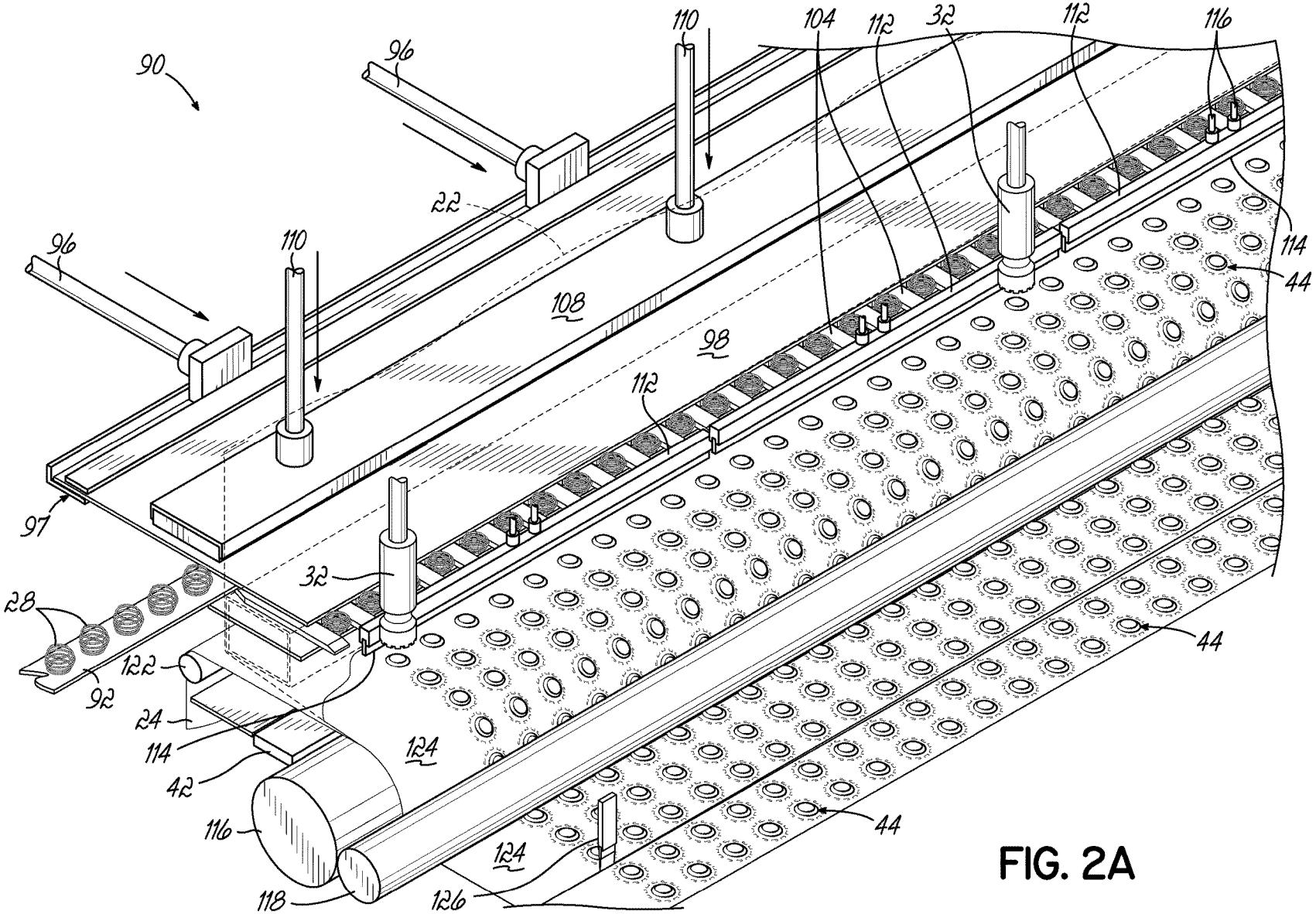
FIG. 2A is a perspective view of a portion of the machine of FIG. 2, the mini coil springs being inserted into predetermined positions.

Machine 90 discloses a conveyor 92 on which are loaded multiple mini coil springs 28. The conveyor 92 moves the mini coil springs 28 in the direction of arrow 94 (to the right as shown in FIG. 2) until the mini coil springs 28 are located in predetermined locations, at which time the conveyor 92 stops moving. Machine 90 further discloses several actuators 96, which move a pusher assembly 97, including a pusher plate 98 in the direction of arrow 100. Although two actuators 96 are illustrated in FIGS. 2 and 2A, any number of actuators 96 of any desired configuration may be used to move the pusher assembly 97. The pusher plate 98 has a plurality of spaced spring pushers 102 secured to the pusher plate 98 underneath the pusher plate 98. The spring pushers 102 push the mini coil springs 28 between stationary guides 104 from a first position shown in FIG. 2 to a second position shown in FIG. 4 in which the mini coil springs 28 are located above the stationary anvil 42 (or above the alternative anvil 42*a* shown in FIG. 4A). FIG. 2A illustrates the mini coil springs 28 being transported from the first position to the second position, each mini coil spring 28 being transported between adjacent stationary guides 104. The stationary guides 104 are secured to a stationary mounting plate 106.

The machine 90 further comprises a compression plate 108, which is movable between raised and lowered positions by lifters 110. Although two lifters 110 are illustrated in FIGS. 2 and 2A, any number of lifters 110 of any desired configuration may be used to move the compression plate 108.

Figure 3A:
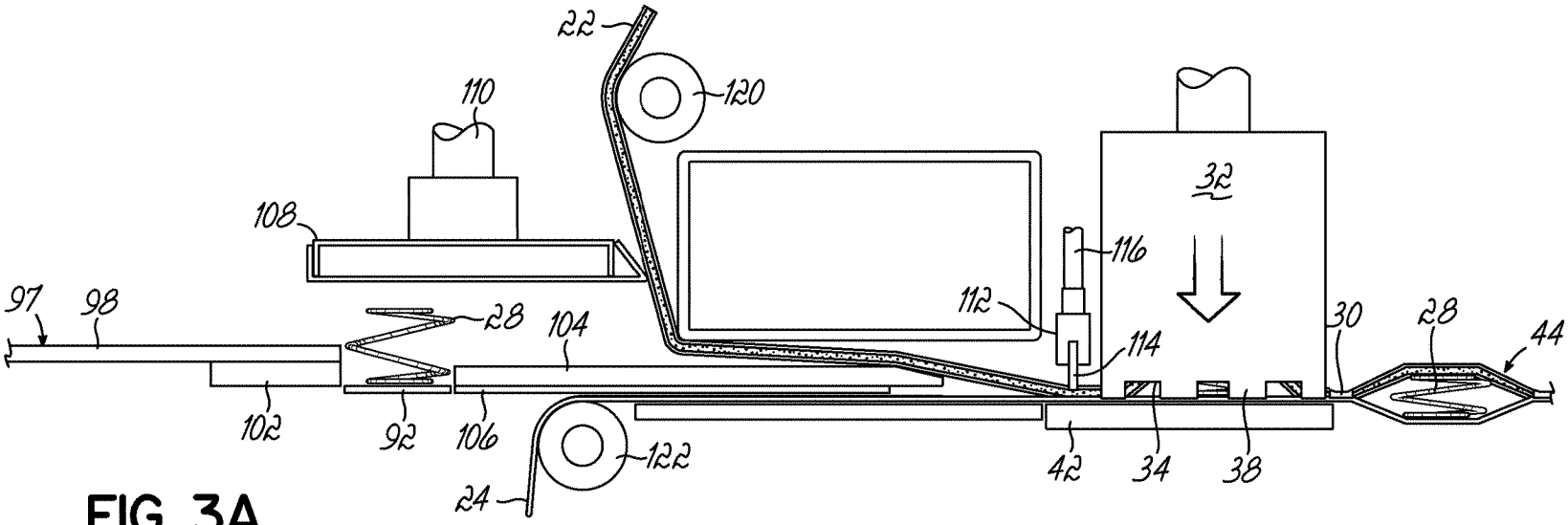
FIG. 3A is a cross-sectional view of a beginning portion of the manufacturing process using the machine of FIGS. 2 and 2A.
Figure 3B:
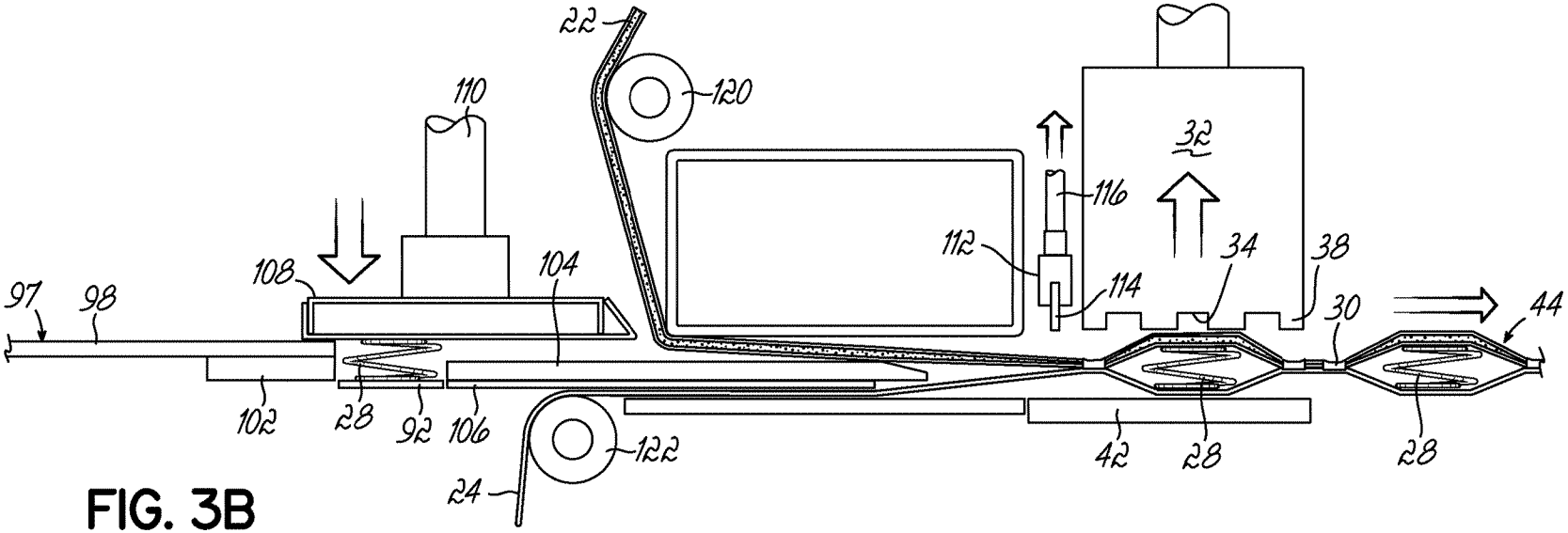
FIG. 3B is a cross-sectional view of the mini coil springs being compressed in the manufacturing process using the machine of FIGS. 2 and 2A.
Figure 3C:
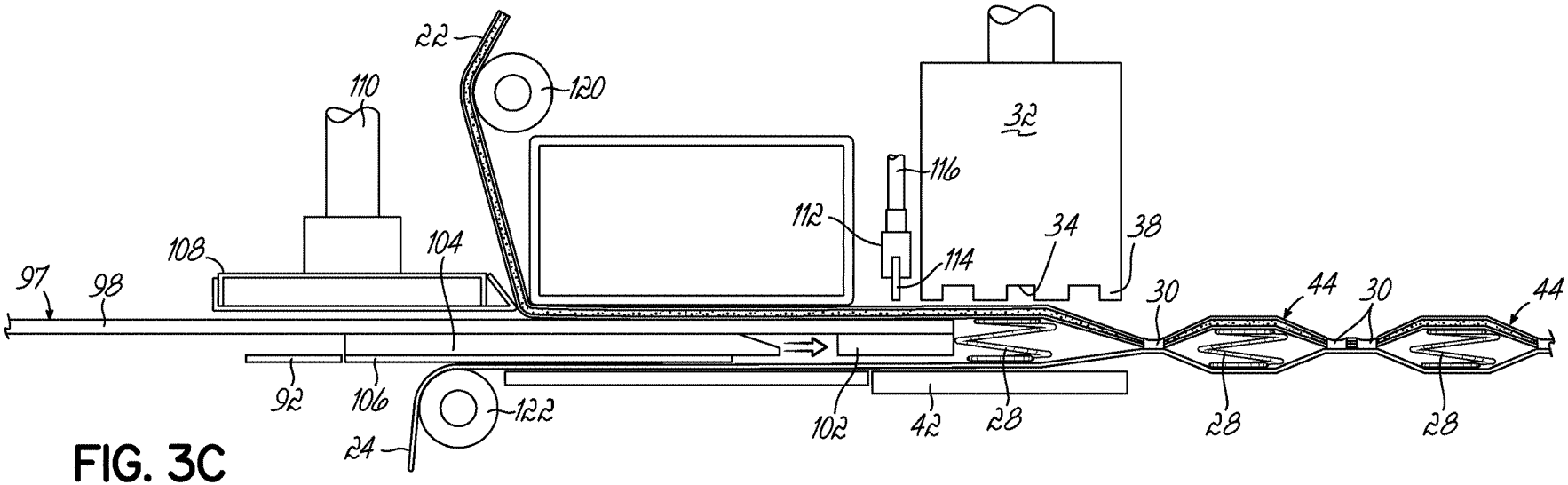
FIG. 3C is a cross-sectional view of the mini coil springs being laterally moved in the manufacturing process using the machine of FIGS. 2 and 2A.
Figure 3D:
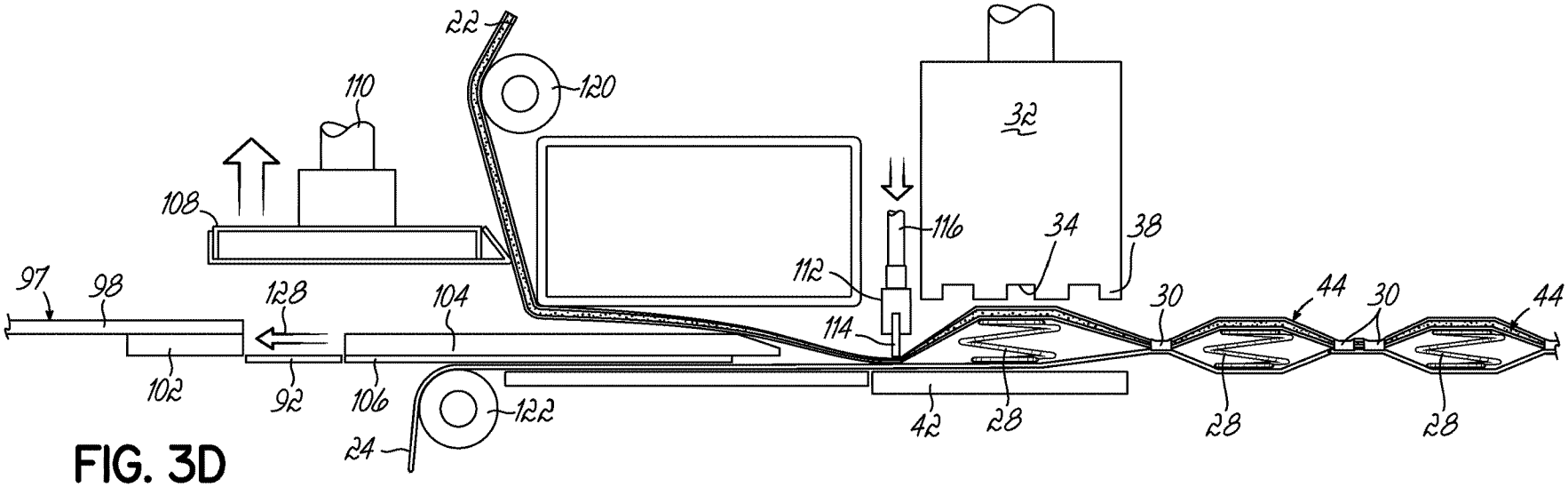
FIG. 3D is a cross-sectional view of the upper ply of fabric being moved in the manufacturing process using the machine of FIGS. 2 and 2A.
Figure 3E:
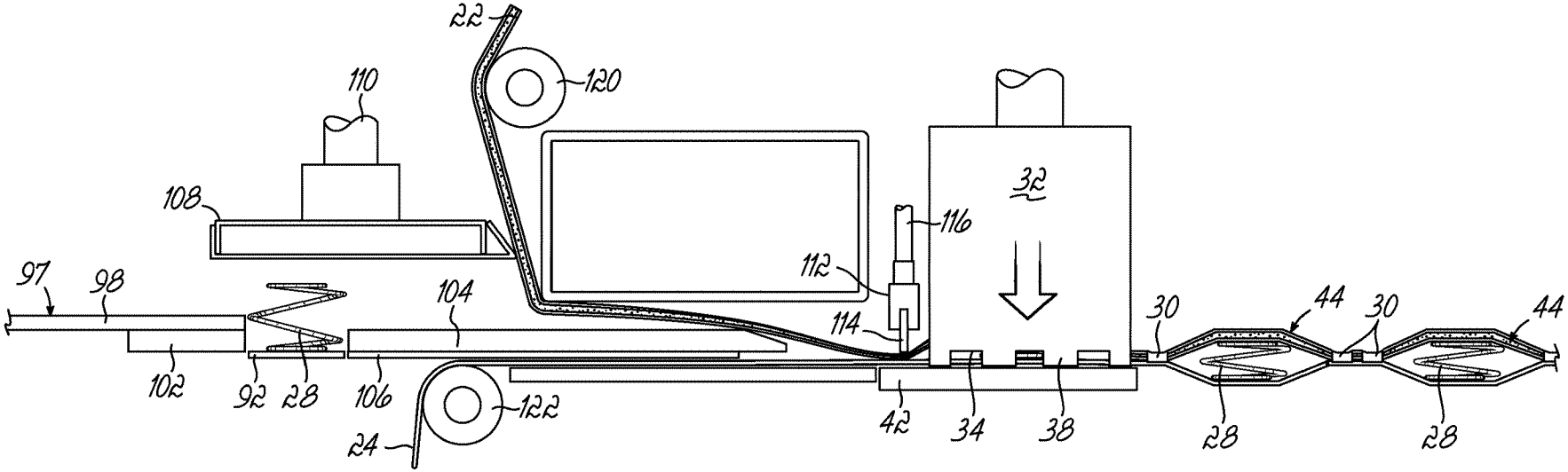
FIG. 3E is a cross-sectional view of one of the mini coil springs being sealed in the manufacturing process using the machine of FIGS. 2 and 2A.
Figure 3A:
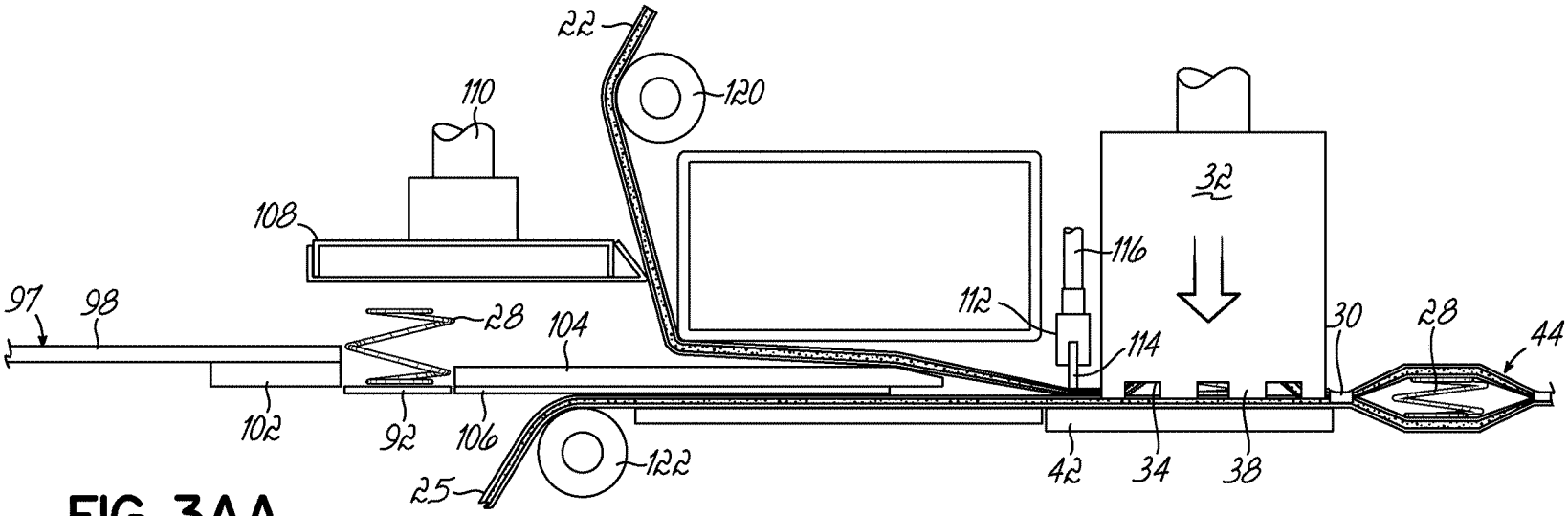
Figure 3B:
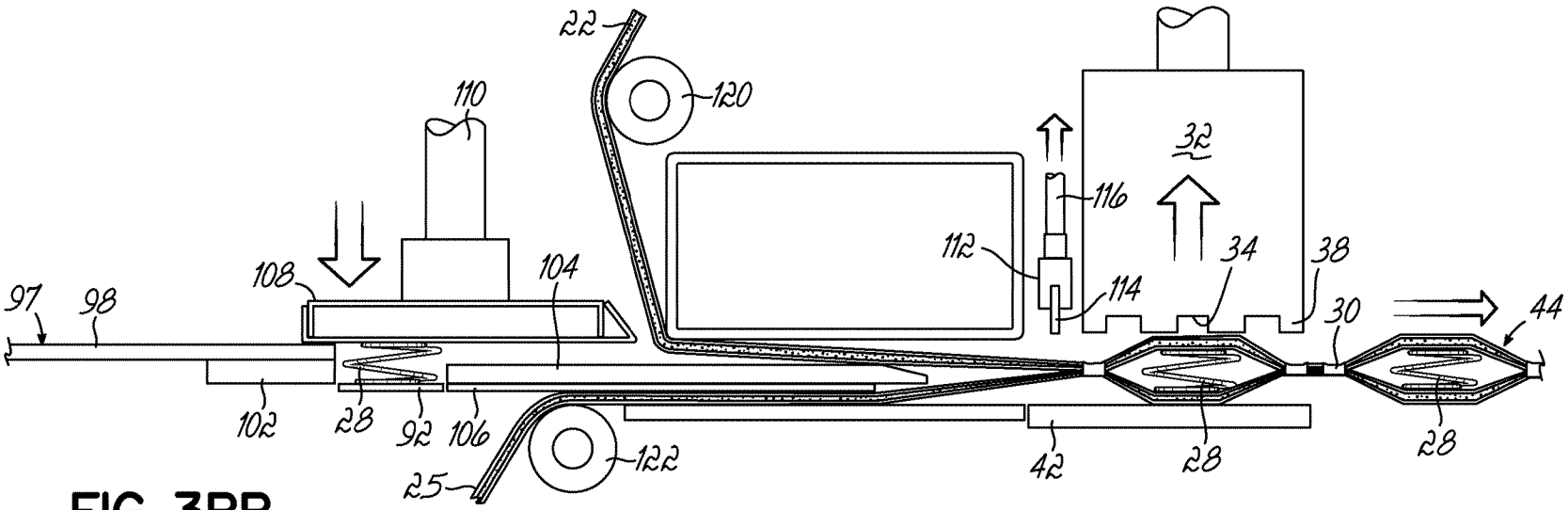
Figure 3C:
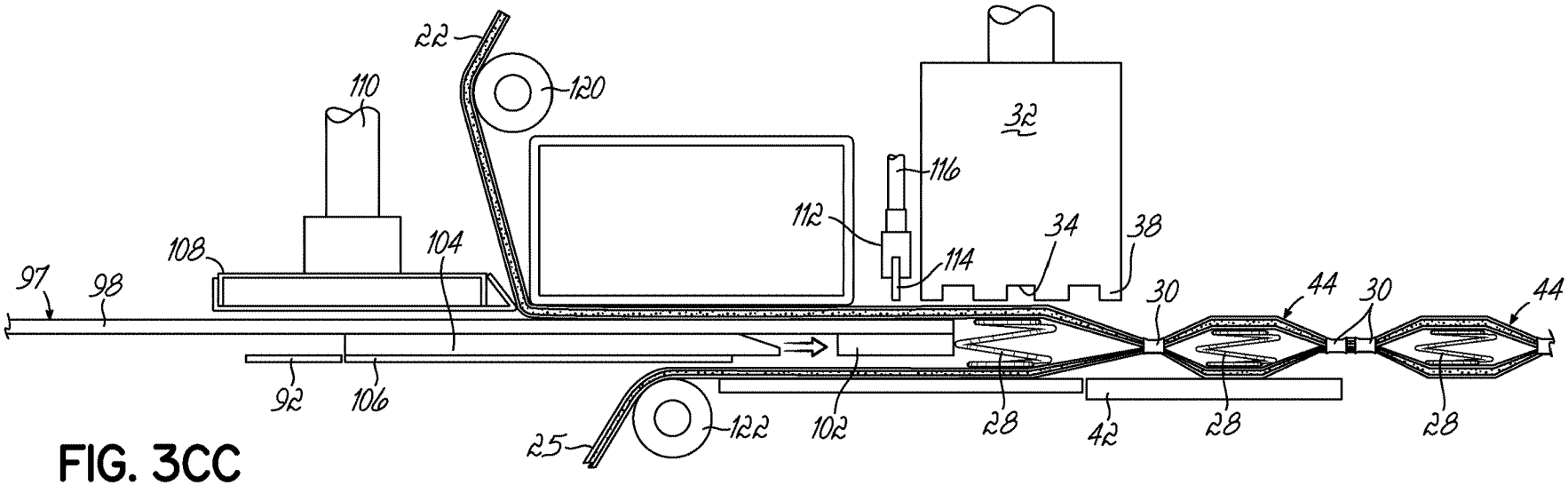
Figure 3D:
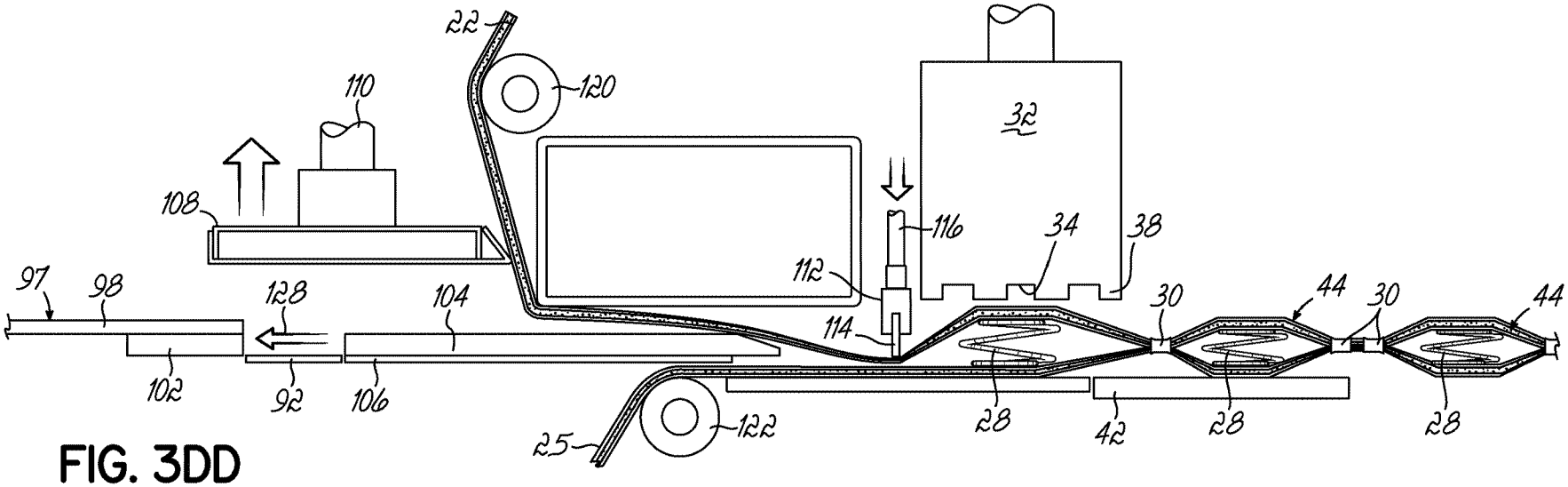
Figure 3E:
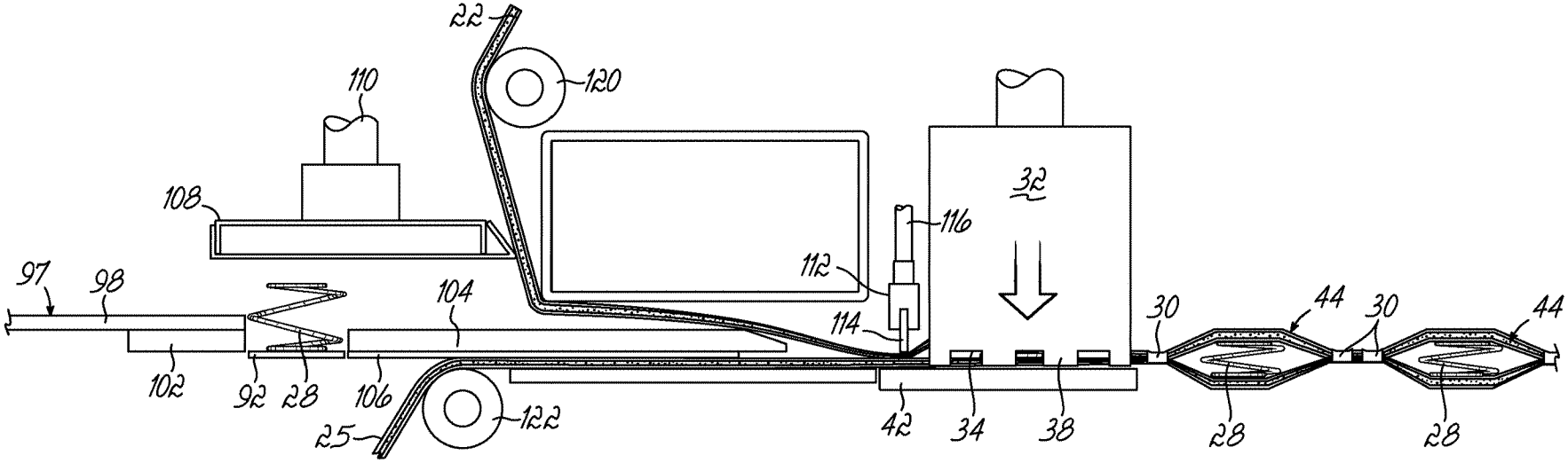

As best shown in FIG. 2, machine 90 further comprises three pressers 112 movable between raised and lowered positions via actuators 116. FIGS. 3B and 3C show one of the pressers 112 in a raised position, while FIGS. 3A, 3D and 3E show the presser in a lowered position. Each presser has a blade 114 at the bottom thereof for bringing the plies 22, 24 of fabric together when the presser is lowered, as shown in FIGS. 3A, 3D and 3E.

As best shown in FIG. 3A, machine 90 further comprises rollers 120, 122 around which the cushion assembly 22 and fabric ply 24, respectively, pass before they come together. After the circular seams 30 are created by the ultrasonic welding horn 32 and anvil 42, thereby creating the pockets 44, a main roller 116 and secondary roller 118 pull the continuous spring blanket 124 downwardly. Once a desired amount of continuous spring blanket 124 is made, a blade 126 cuts the continuous spring blanket 120 to create comfort layer 16 of the desired size. Of course, the machine 90 may be programmed to create the desired length and width of comfort layer. This machine 90 is adapted to make any of the comfort layers shown or disclosed herein having circular weld seams.

FIG. 3A illustrates the ultrasonic welding horn 32 in a lowered position contacting the stationary anvil 42 with at least one of the pressers 112 in a lowered position pressing the cushion assembly 22 into contact with the lower ply 24. A new row of mini coil springs 28 has been moved into a loading position with the compression plate 108 in its raised position.

FIG. 3B illustrates the ultrasonic welding horn 32 in a raised position spaced from the anvil 42 with at least one of the pressers 112 in a raised position. The compression plate 108 is moved to its lowered position by lifters 110, thereby compressing the row of mini coil springs 28 located on the conveyor 92.

FIG. 3C illustrates the row of compressed mini coil springs 28 located on the conveyor 92 being pushed downstream towards the ultrasonic welding horn 32 and stationary anvil 42 by the pusher assembly 97. More particularly, the pushers 102 secured to the pusher plate 98 contact the compressed mini coil springs 28 and move them downstream between the stationary guides 104 and past the raised pressers 112.

FIG. 3D illustrates the pusher assembly 97 being withdrawn in the direction of arrow 128. Additionally, the pressers 112 are moved to a lowered position, pressing the cushion assembly 22 into contact with the lower ply 24. Also, the compression plate 108 is moved to its raised position by lifters 110.

FIG. 3E illustrates the ultrasonic welding horn 32 in a lowered position contacting the stationary anvil 42 with at least one of the pressers 112 in a lowered position pressing the cushion assembly 22 into contact with the lower ply 24. A new row of mini coil springs 28 has been moved by the conveyor 92 into a position in which they may be compressed with the compression plate 108 during the next cycle.

FIG. 3AA-3EE illustrate the same process shown in FIG. 3A-3E but with two cushion assemblies 22, 24 being secured together to create the pockets.

Figure 9:
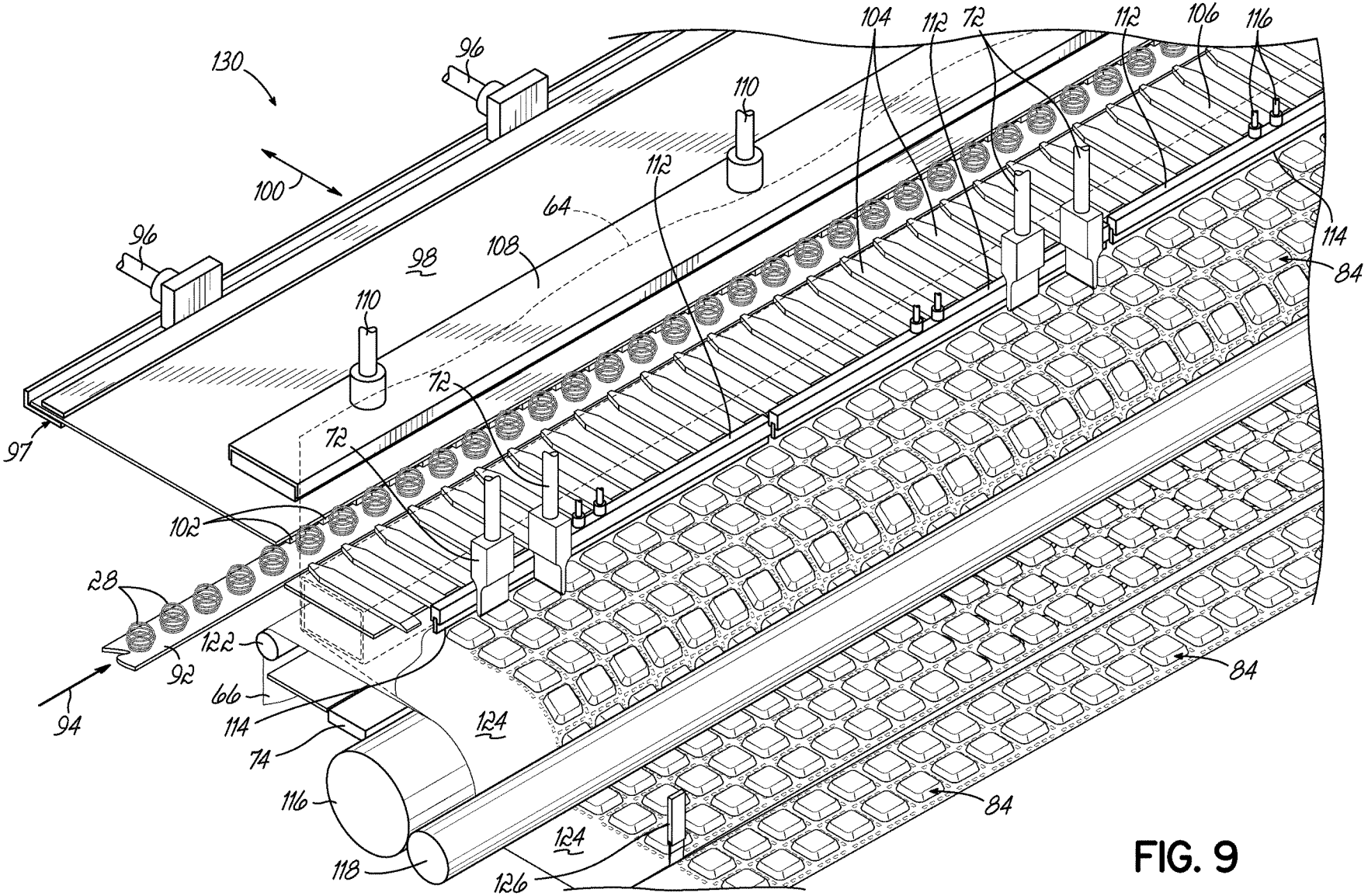
FIG. 9 is a perspective view of the pocketed spring comfort layer of FIG. 8 being manufactured.

FIG. 9 illustrates a machine 130, like the machine 90 shown in FIGS. 2 and 2A. However, instead of having two ultrasonic welding horns 32, machine 130 has four ultrasonic welding horns 72 along with anvil 74. Alternatively, ultrasonic welding horns 72*a* and anvil 74*a* of FIG. 10A may be used in machine 130. This machine 124 is adapted to make any of the comfort layers shown or disclosed herein having rectangular weld seams, as opposed to circular weld seams.

Figure 14:
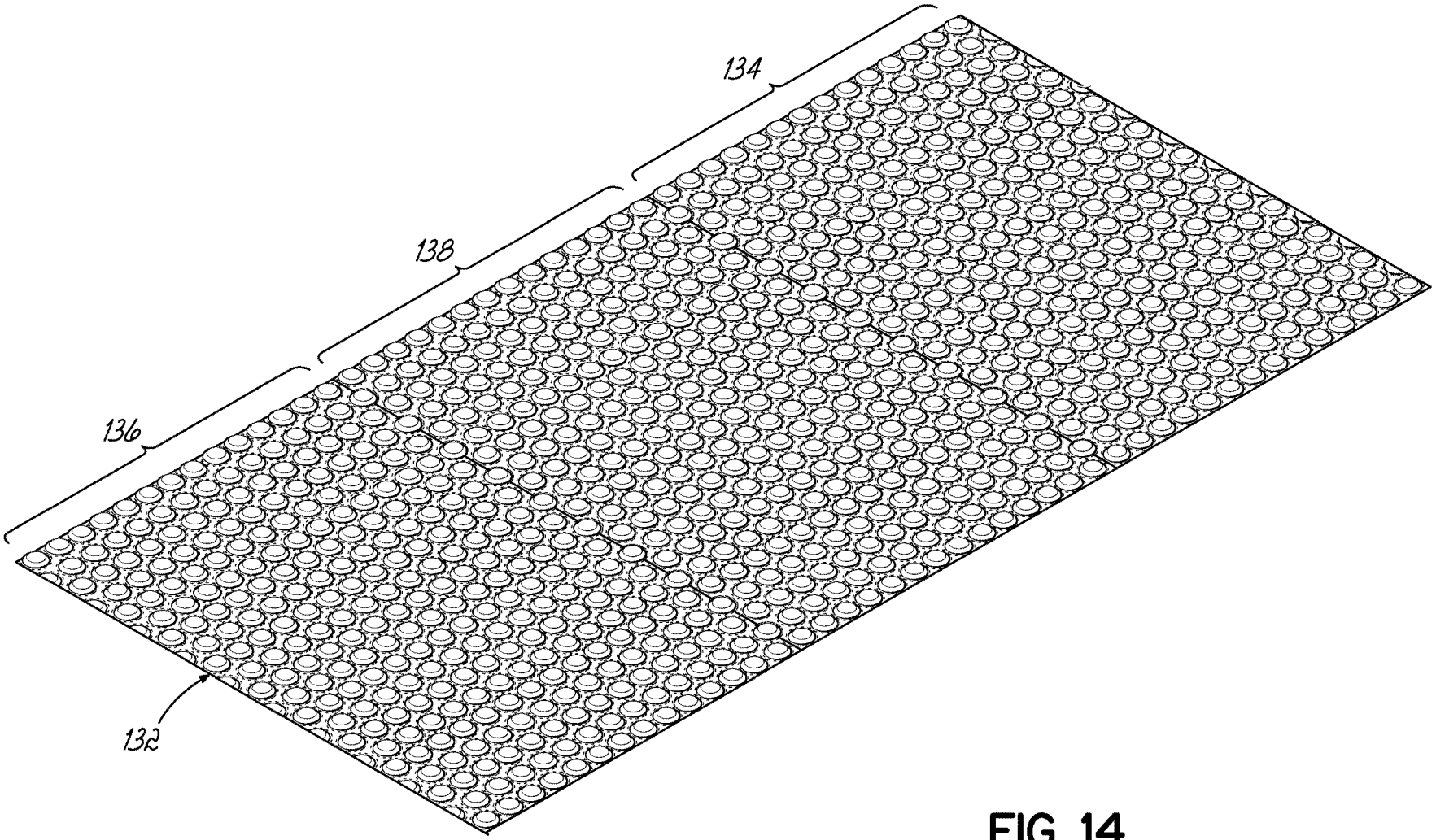
FIG. 14 is a perspective view of a posturized pocketed spring comfort layer.

FIG. 14 illustrates a posturized comfort layer 132 having three different areas or regions of firmness depending upon the airflow within each of the areas or regions. The comfort layer 132 has a head section 134, a foot section 136 and a lumbar or middle section 138 therebetween. Although three sections are illustrated in FIG. 14, any number of sections may be incorporated into a posturized comfort layer. Although each of the sections is illustrated being a certain size, they may be other sizes. The drawings are not intended to be limiting. Although FIG. 14 shows each of the segmented seams of comfort layer 132 being circular, a posturized comfort layer, such as the one shown in FIG. 14, may have rectangular or square segmented seams.

Figure 15:
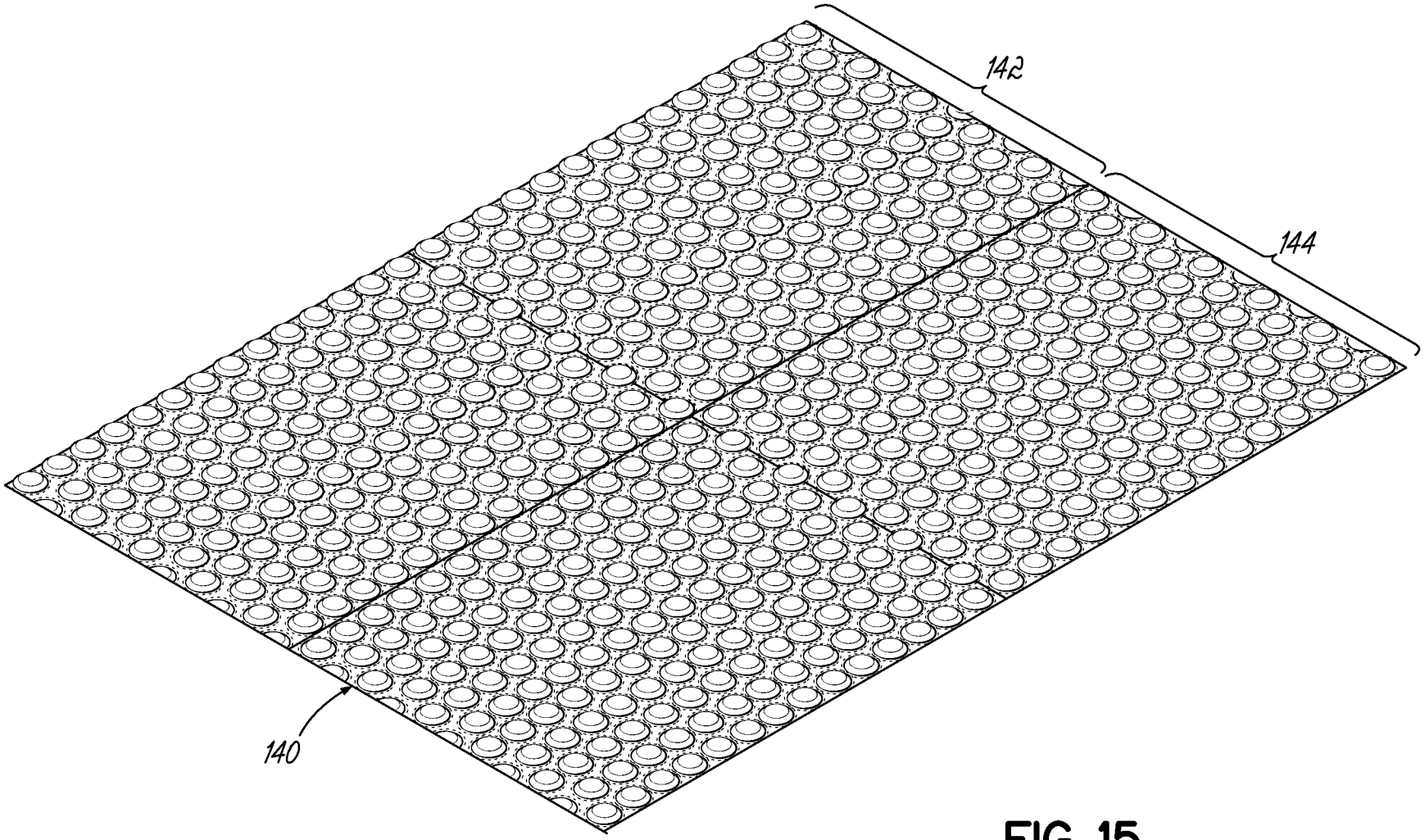
FIG. 15 is a perspective view of another posturized pocketed spring comfort layer.

FIG. 15 illustrates a posturized comfort layer 140 having two different areas or regions of firmness depending upon the airflow within each of the areas or regions. The comfort layer 140 has a first section 142 and a second section 144. The size and number of segments in the seams, along with the type of material used to construct the posturized comfort layer 140, may be selected so at least two of the sections may have a different firmness due to different airflows within different sections. Although two sections are illustrated in FIG. 15, any number of sections may be incorporated into a posturized comfort layer. Although each of the sections is illustrated being a certain size, they may be other sizes. The drawings are not intended to be limiting. Although FIG. 15 shows each of the segmented seams of comfort layer 140 being circular, a posturized comfort layer, such as the one shown in FIG. 15, may have rectangular or square segmented seams.

While we have described several preferred embodiments of this invention, persons skilled in this art will appreciate that other semi-impermeable and non-permeable fabric materials may be utilized in the practice of this invention. Similarly, such persons will appreciate that each pocket may contain any number of coil springs or other type of spring, made of any desired material. Persons skilled in the art may further appreciate that the segments of the weld seams may be stitched, glued or otherwise adhered or bonded. Therefore, we do not intend to be limited except by the scope of the following appended claims.

What is claimed is:

1. A pocketed spring comfort layer configured to overlay a core of a bedding or seating product, said pocketed spring comfort layer comprising: a matrix of interconnected pocketed mini springs, each mini spring of which is contained within a pocket between cushion assemblies on opposite sides of the pocket, each pocket having a weld seam surrounding the pocket joining the cushion assemblies, wherein each of the cushion assemblies includes a layer of foam and at least one layer of fabric; wherein the weld seam extends through the layers of foam of the cushion assemblies.

2. The comfort layer of claim 1 wherein the weld seam is segmented.

3. The comfort layer of claim 1 wherein the weld seam is circular.

4. The comfort layer of claim 1 wherein the weld seam is rectangular.

5. The comfort layer of claim 1 wherein each of the cushion assemblies includes a layer of foam sandwiched between inner and outer layers of fabric.

6. The comfort layer of claim 5 wherein the fabric is a non-woven fabric.

7. The comfort layer of claim 1 wherein the foam is polyurethane foam.

8. The comfort layer of claim 1 wherein the foam is viscoelastic foam.

9. The comfort layer of claim 1 wherein the foam is latex foam.

10. A pocketed spring comfort layer for a bedding or seating product, said pocketed spring comfort layer comprising: a matrix of interconnected pocketed mini springs, each mini spring of which is contained within a pocket between an upper cushion assembly and a bottom cushion assembly, each cushion assembly comprising an inner fabric layer, an outer fabric layer and a middle foam layer, each pocket having a weld seam surrounding the pocket joining the cushion assemblies; wherein the weld seam extends through the layers of foam of the cushion assemblies.

11. The comfort layer of claim 10 wherein at least one of the inner and outer fabric layers comprises a non-woven fabric.

12. The comfort layer of claim 10 wherein said weld seam is segmented weld seam.

13. The comfort layer of claim 10 wherein the weld seam is circular.

14. The comfort layer of claim 10 wherein the weld seam is rectangular.

15. The comfort layer of claim 10 wherein at least one of said cushion assemblies comprises a foam layer sandwiched between layers of non-woven polypropylene.

16. A pocketed spring comfort layer for a bedding or seating product, said pocketed spring comfort layer comprising: a matrix of interconnected pocketed mini springs, each mini spring of which is contained within a pocket between multi-layered cushion assemblies, each pocket having a weld seam surrounding the pocket joining the multi-layered cushion assemblies of the pocket, each multi-layered cushion assembly comprising a layer of foam between inner and outer layers of fabric; wherein the weld seam extends through the layers of foam of the multi-layered cushion assemblies.

17. The comfort layer of claim 16 wherein the weld seam is segmented.

18. The comfort layer of claim 17 wherein said segmented weld seam is circular and the weld segments are curved.

19. The comfort layer of claim 17 wherein said segmented weld seam is rectangular and the weld segments are linear.

20. The comfort layer of claim 17 wherein each multi-layered cushion assembly has at least three layers.

* * * * *